US009836905B2

(12) United States Patent
Chutorash et al.

(10) Patent No.: US 9,836,905 B2
(45) **Date of Patent: *Dec. 5, 2017**

(54) SYSTEM FOR CAUSING GARAGE DOOR OPENER TO OPEN GARAGE DOOR AND METHOD

(71) Applicant: Gentex Corporation, Zeeland, MI (US)

(72) Inventors: Richard J. Chutorash, Rochester Hills, MI (US); Philip J. Vanderwall, Marne, MI (US)

(73) Assignee: GENTEX CORPORATION, Zeeland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/985,555

(22) Filed: Dec. 31, 2015

(65) Prior Publication Data

US 2016/0117879 A1 Apr. 28, 2016

Related U.S. Application Data

(63) Continuation of application No. 14/171,690, filed on Feb. 3, 2014, now Pat. No. 9,230,378, which is a (Continued)

(51) Int. Cl.
*G08B 21/00* (2006.01)
*G07C 9/00* (2006.01)
(Continued)

(52) U.S. Cl.
CPC ..... *G07C 9/00896* (2013.01); *E05F 15/668* (2015.01); *E05F 15/72* (2015.01);
(Continued)

(58) Field of Classification Search
CPC ..... E05Y 2900/106
(Continued)

(56) References Cited

U.S. PATENT DOCUMENTS 4,360,801 A 11/1982 Duhame
5,576,739 A 11/1996 Murphy
(Continued)

FOREIGN PATENT DOCUMENTS

DE 1020040 44 663 A1 4/2005
FR 2881304 A1 7/2006

OTHER PUBLICATIONS

U.S. Appl. No. 12/328,663, filed Dec. 4, 2008, Richard Chutorash.
(Continued)

*Primary Examiner* — Mark Rushing
(74) *Attorney, Agent, or Firm* — Foley & Lardner LLP; Bradley D. Johnson

(57) ABSTRACT

A system and a method for causing a garage door to open using a garage door opener having a wireless receiver is provided. The system comprises an interface coupled to an environment sensor and configured to receive data from the environment sensor. The system can include processing electronics coupled to the interface and configured to receive the data from the interface and to use the received data to determine whether an environmental condition exists. The processing electronics provide a command to cause the garage door opener to open the garage door based on the determination of whether the environmental condition exists.

20 Claims, 11 Drawing Sheets

Related U.S. Application Data continuation of application No. 12/348,154, filed on Jan. 2, 2009, now Pat. No. 8,643,467.

(51) Int. Cl.
*E05F 15/72* (2015.01)
*E05F 15/668* (2015.01)

(52) U.S. Cl.
CPC ..... *G07C 9/00126* (2013.01); *G07C 9/00182* (2013.01); *E05Y 2800/42* (2013.01); *E05Y 2900/106* (2013.01); *G07C 2009/00769* (2013.01); *G07C 2009/00928* (2013.01); *G07C 2209/64* (2013.01)

(58) Field of Classification Search
USPC ..... 340/5.2, 5.23, 5.64, 5.71, 825.69; 380/270
See application file for complete search history.

(56) References Cited

U.S. PATENT DOCUMENTS

| | | | |
|---|---|---|---|
| 6,091,330 | A | 7/2000 | Swan et al. |
| 6,271,765 | B1 | 8/2001 | King et al. |
| 6,559,775 | B1 | 5/2003 | King |
| 7,183,933 | B2 | 2/2007 | Dzurko et al. |
| 7,327,108 | B2 | 2/2008 | Mullet et al. |
| 2003/0067380 | A1 | 4/2003 | Bedi et al. |
| 2003/0210131 | A1 | 11/2003 | Fitzgibbon et al. |
| 2005/0212681 | A1 | 9/2005 | Dzurko et al. |
| 2006/0202815 | A1 | 9/2006 | John |
| 2007/0046232 | A1 | 3/2007 | Mullet et al. |
| 2007/0063815 | A1 | 3/2007 | Tsui et al. |
| 2009/0128363 | A1 | 5/2009 | Wagenhuber et al. |
| 2009/0170434 | A1 | 7/2009 | Tengler et al. |

OTHER PUBLICATIONS

U.S. Appl. No. 12/344,082, filed Dec. 24, 2008, Todd Witkowski.
U.S. Appl. No. 12/372,653, filed Feb. 17, 2009, Richard Chutorash.
Advisory Action in U.S. Appl. No. 12/348,154 dated Oct. 3, 2012.
European Patent Office Action for EP 09015700.9, dated Jul. 7, 2011, 4 pages.
European Patent Office Action for EP 09015700.9, dated Mar. 30, 2012, 5 pages.
Notice of Allowance in U.S. Appl. No. 12/348,154 dated Sep. 30, 2013.
Notice of Allowance in U.S. Appl. No. 14/171,690 dated Sep. 2, 2015.
Office Action in U.S. Appl. No. 12/348,154 dated Mar. 18, 2013.
Office Action in U.S. Appl. No. 12/348,154 dated Jun. 11, 2012.
Office Action in U.S. Appl. No. 14/171,690 dated Mar. 23, 2015.
Search Report for European Patent Application No. 09015700.9, dated Mar. 15, 2010, 5 pages.
Search Report in corresponding European Application No. 09 015 700.9 dated Aug. 6, 2013, 4 pages.
U.S. Office Action in U.S. Appl. No. 12/348,154 dated Nov. 2, 2011.
Office Action dated Dec. 19, 2016, received in corresponding European application No. 14 003 637.7, 4 pages.

SYSTEM FOR CAUSING GARAGE DOOR OPENER TO OPEN GARAGE DOOR AND METHOD

CROSS REFERENCE TO RELATED APPLICATIONS

This application is a continuation of U.S. patent application Ser. No. 14/171,690, titled "System for Causing Garage Door Opener to Open Garage Door and Method," filed Feb. 3, 2014, which is a continuation of and claims benefit to prior U.S. patent application Ser. No. 12/348,154, filed Jan. 2, 2009, the entire contents of which are hereby incorporated by reference in their entireties.

FIELD OF THE INVENTION

The present invention relates generally to the field of electronic garage door opener systems. More specifically, the present invention relates to electronic garage door opener systems configured to actuate the garage door, such as in the event of an emergency condition.

BACKGROUND

More and more vehicles are equipped with remote starting capability. Remote starters allow the vehicle user to, for example, push a button on a key fob from inside the house to start the vehicle's engine, thereby allowing the vehicle engine time to warm up or the vehicle's interior environment to adjust to the user's desired settings. The user's vehicle may be located outside or in an enclosed area, such as a closed garage. If the vehicle is outside, the surrounding environment is able to dissipate the harmful emissions. However, if the vehicle is located in a closed garage, the environmental conditions, such as emissions and temperature, resulting from the vehicle's engine may reach levels that are dangerous, and even fatal, to humans and animals located in, or above, the garage. One way to solve this problem is for the user to enter the garage and manually actuate the garage door to provide proper ventilation. However, situations may arise where the car is accidentally started (e.g., child playing with the remote starter) or the user forgets to open the garage door.

Additionally, Plug in hybrid electric vehicles (PHEV) may be utilized for backup electrical power generation in the event of a power outage. The engine of the PHEV may be configured to automatically turn on during a power outage to keep appliances, such as the refrigerator or HVAC, operating. Combustion engine electrical power generators may be utilized to perform the same function. If located in an enclosed garage, both PHEVs and combustion engine generators are capable of creating harmful environmental conditions reaching levels that are dangerous, and even fatal, to humans and animals located in, or above, the garage. This configuration is particularly problematic because the power outage may occur while the user is sleeping or outside the house and the starting of the PHEV or combustion engine generator may go unnoticed by the user. Even if the power outage is noticed by the user, when the power returns as a result of the PHEV or combustion engine generator, the user may incorrectly believe that power from the electrical power grid has been restored. In either case, the result is that the user fails to open the garage door to provide proper ventilation.

Accordingly, there is a need for a system and method to address these and/or other issues.

SUMMARY

A first embodiment includes a system for causing a garage door opener to open a garage door. The system comprises an interface coupled to an environment sensor and configured to receive data from the environment sensor. The system also includes processing electronics coupled to the interface, configured to receive data from the interface, configured to use the received data to determine whether an environmental condition exists, and configured to provide a command to cause the garage door opener to open the garage door based on a determination that the environmental condition exists.

A second embodiment includes a method for causing a garage door opener to open a garage door. The method comprises receiving data from an environment sensor and determining that an environmental condition exists based on the received data. The method further comprises providing a command to cause the garage door opener to open the garage door, wherein providing the command is based on the determination that the environmental condition exists.

A third embodiment includes a system for a vehicle and configured to cause a garage door opener to open a garage door. The system comprises an interface coupled to a first sensor and configured to receive first data from the first sensor. The system further comprises processing electronics coupled to the interface, configured to receive the first data from the interface, and configured to use the first data to determine whether to actuate the garage door. The system further comprises a transmitter coupled to the processing electronics and configured to receive a command from the processing electronics and to transmit a control signal to a wireless receiver of the garage door opener in response to the command, the control signal formatted for recognition by the wireless receiver and to cause the garage door opener to open the garage door. The processing electronics provides the command to the transmitter based on the determination of whether to actuate the garage door.

A fourth embodiment includes a garage door opener configured to actuate a garage door and coupled to a wireless receiver for receiving a control signal. The garage door opener comprises an interface coupled to a first sensor and configured to receive first data. The garage door opener further comprises processing electronics coupled to the interface and configured to receive the first data from the interface and to use the first data to determine whether to actuate the garage door. The processing electronics provides a command to the garage door opener to actuate the garage door based on the determination of whether to actuate the garage door.

A fifth embodiment includes a method for opening a garage door using a garage door opener. The method comprises receiving first data from a first sensor and receiving second data from a remote source via a wireless receiver. The method further comprises determining whether to actuate the garage door based on the first and second data received, and providing a command to cause the garage door opener to open the garage door. Providing the command is based on the determination of whether to actuate the garage door.

DETAILED DESCRIPTION OF THE PREFERRED EMBODIMENTS

Figure 1:
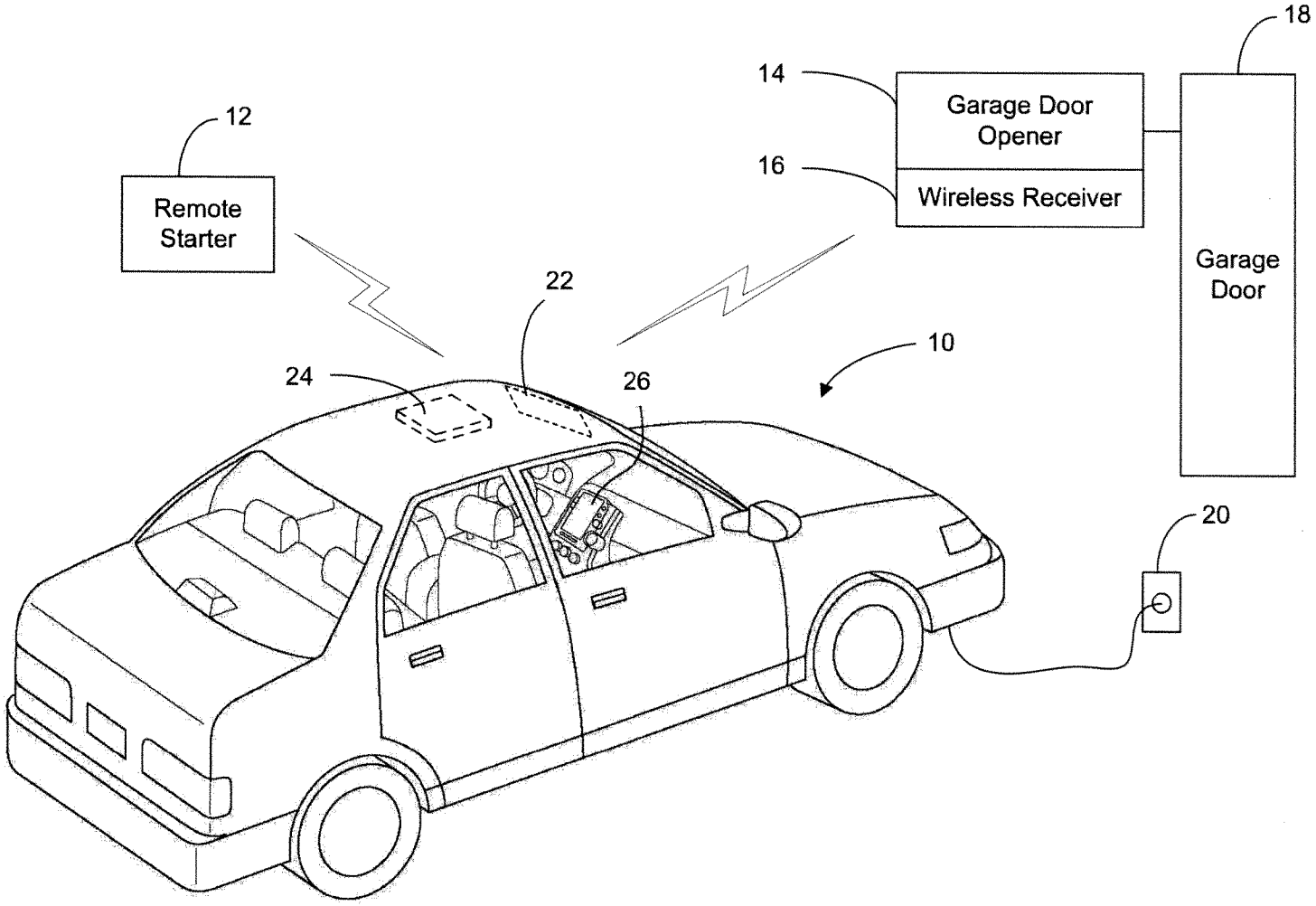
FIG. 1 is a perspective view of an emergency garage door actuation configuration including a garage door opener and a vehicle in accordance with an embodiment.

FIG. 1 is a perspective view of a garage door opener 14 and vehicle 10 including an electronic transmitter in accordance with an embodiment. A vehicle 10, which may be an automobile, truck, sport utility vehicle (SUV), mini-van, or other vehicle, includes an electronic transmitter 24. In alternative embodiments, an electronic transmitter 24 may be embodied in other systems such as a portable housing, key fob, key chain, other hand-held device, or any other device. In FIG. 1, electronic transmitter 24 is illustrated mounted to an overhead console of vehicle 10. Alternatively, one or more of the elements of electronic transmitter 24 may be mounted to other vehicle interior elements such as a visor 22, an instrument panel 26, a rearview mirror (not shown), a dashboard, seat, center console, door panel, or other appropriate location in the vehicle.

Electronic transmitter 24 may be configured to control a garage door opener 14 (e.g., to issue a signal that causes the garage door opener 14 to open a garage door). Electronic transmitter 24 may be trained using an original transmitter used to control garage door opener 14. Original transmitter is a transmitter, typically a hand-held transmitter, which is sold with garage door opener 14 or as an after-market item, and which is configured to transmit an activation signal at a predetermined carrier frequency and having control data configured to actuate garage door opener 14. For example, original transmitter can be a hand-held garage door opener transmitter configured to transmit a garage door opener signal at a frequency, such as 355 Megahertz (MHz), wherein the activation signal has control data, which can be fixed code or cryptographically-encoded code (e.g., a rolling code). In this example, garage door opener 14 may be configured to open a garage door 18 in response to receiving the activation signal from an original transmitter. Accordingly, garage door opener 14 includes receiver 16 for receiving wireless signals including control data, which would control garage door opener 14.

Vehicle 10 may be configured with a remote starter 12 for remotely starting the engine of vehicle 10. Remote starter 12 may be a portable housing, key fob, key chain, other hand-held device, or any other device. Vehicle 10 may also be a plug in hybrid electric vehicle (PHEV) that plugs into wall plug 20 to recharge battery cells during inoperable periods. PHEV may also be configured to act as an electrical power generator to supply power through wall plug 20 in the event of an electrical power outage. PHEV may be configured to automatically start its combustion engine to generate electrical power during a power outage or it may require manual or remote ignition. Alternatively, in various embodiments, vehicle 10 may be a combustion engine electrical power generator configured to be either manually, remotely or automatically actuated in the event of a power outage.

To properly actuate the garage door 18 and avoid a harmful garage environment created by vehicle 10, several determinations can be made, including: whether vehicle 10 has been started, whether vehicle 10 is located in the garage, and whether the garage door 18 is open. If the only determination made is that vehicle 10 is started, then the garage door 18 may be actuated if, for example, the vehicle 10 were located in the driveway, which may be an unnecessary actuation of the garage door. If the only determinations made were that vehicle 10 is started and that vehicle 10 is located in the garage, then the garage door 18 may be improperly actuated if, for example, the garage door 18 were already opened. Determining whether to actuate the garage door 18 in response to a harmful garage environment may be made by vehicle 10, garage door opener 14, or vehicle 10 in conjunction with garage door opener 14. At least one sensor disposed in either the garage or vehicle 10 may be configured to provide the information needed to determine whether to properly actuate the garage door 18.

Emergency Actuation Determined by the Vehicle

Figure 2A:
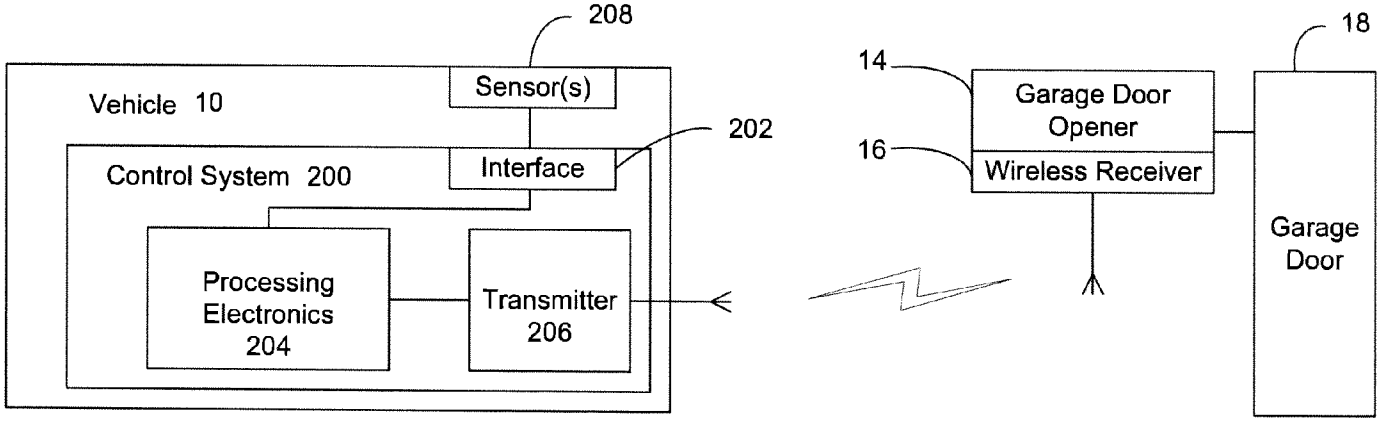
FIG. 2A is a schematic block diagram of an control system in a vehicle configured to determine conditions for actuating a garage door in accordance with an embodiment.

Referring to FIG. 2A, in a first exemplary embodiment, vehicle 10 may be include a control system 200 for opening a garage door using a garage door opener 14 that is remote from the vehicle. The control system 200 may include, an interface 202, processing electronics 204, transmitter 206 and sensor(s) 208. Interface 202 may be configured to receive data from sensor(s) 208 disposed in or on the vehicle 10. The interface being coupled to processing electronics 204 and configured to communicate the received data to the processing electronics 204. The processing electronics 204 is configured to process the data to determine whether the garage door 18 should be actuated. For example, the processing electronics 204 may need to determine whether the vehicle engine is started, whether the vehicle is in the garage and whether the garage door is closed. If the processing electronics 204 determines that the garage door 18 should be actuated, processing electronics 204 provides an actuation command to transmitter 206. For example, an actuation command may be provided if the vehicle is started, the vehicle is in the garage and the garage door is closed. Alternatively, an actuation command may be provided when an environmental condition is determined to exist (e.g., high vehicle emission level). Transmitter 206 is configured to receive the actuation command from processing electronics 204 and to generate a control signal for transmission to the a wireless receiver 16 of the garage door opener 14. The transmitter 206 provides a control signal that is formatted for recognition by the wireless receiver. The wireless receiver 16 receives the control signal from transmitter 206 and provides an appropriately formatted signal to the garage door opener 14, and in response, the garage door opener 14 opens the garage door 18.

Figure 2B:
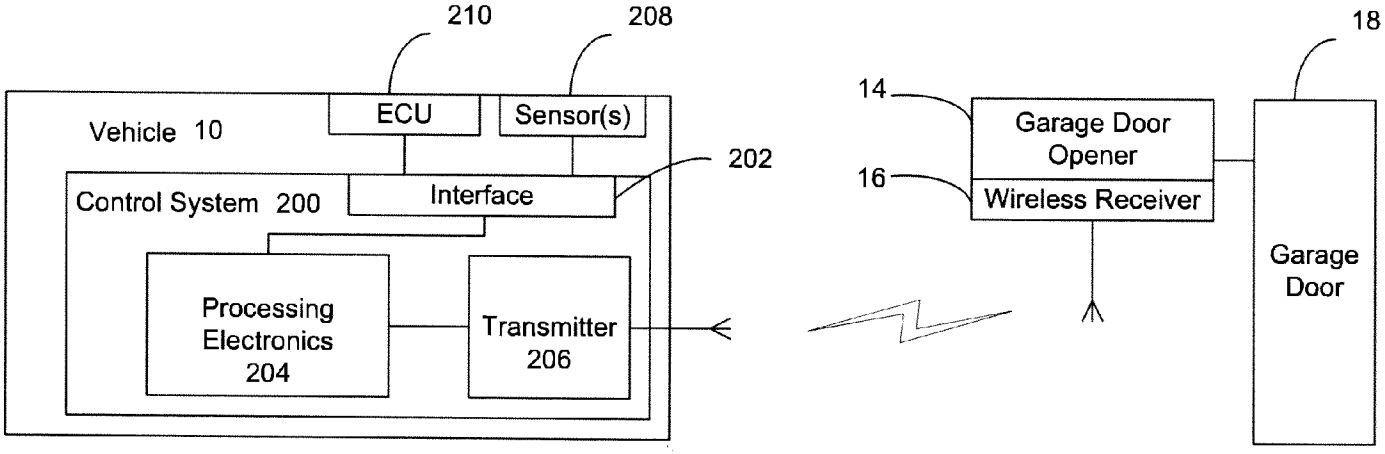
FIG. 2B is a schematic block diagram of an control system in a vehicle configured to determine conditions for actuating a garage door in accordance with an embodiment.

Referring to FIG. 2B, interface 202 may also be coupled to the vehicle's engine control unit (ECU) 210 or other vehicle systems. In particular, ECU 210 and other vehicle systems may be well suited for providing data indicating that the vehicle engine is started. Other vehicle systems for determining whether the engine is started may include the vehicle's ignition system, including components for remote starting and push button engine ignition. When vehicle 10 is started, ECU 210 or other vehicle systems may be configured to provide data to interface 202. The received data is provided to processing electronics 204 for determining whether the vehicle engine is started.

Figure 3:
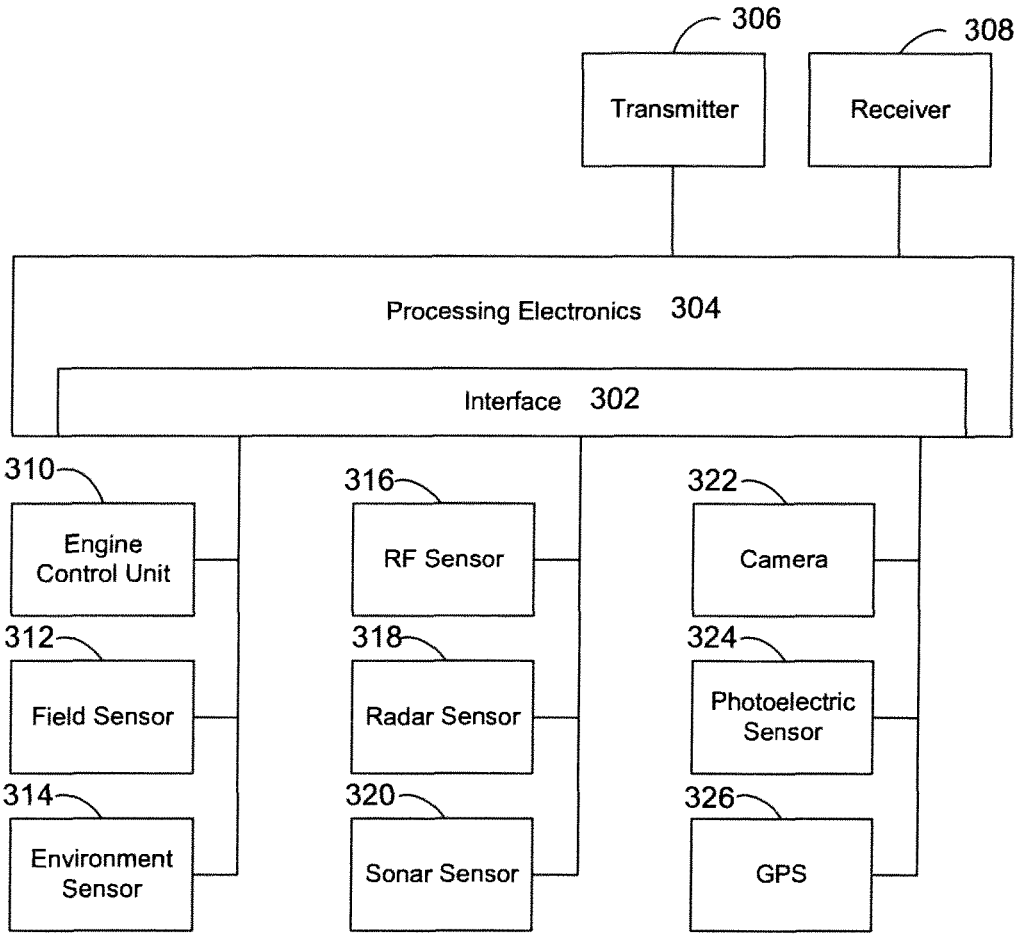
FIG. 3 is a schematic block diagram of sensors coupled to a control system in a vehicle configured to determine conditions for actuating a garage door in accordance with an embodiment.

As described above with respect to FIGS. 2A-B, interface 202 may be coupled to sensor(s) 208. The interface is also coupled to processing electronics 204 and configured to provide data from sensor(s) 208 to processing electronics 204. Processing electronics 204 uses the received data to determine whether an actuation command should be provided. FIG. 3 shows some of the various types of sensors that may be coupled to interface 302. Interface 302 is coupled to processing electronics 304 and communicates data from the various sensors to processing electronics 304. Transmitter 306 is coupled to processing electronics and configured to receive an actuate command from processing electronics 304. Transmitter 306 is configured to generate and transmit a control signal in response to an actuation command. Receiver 308 is coupled to processing electronics 304 and configured to receive signals from remote transmitters (e.g., an original transmitter, transmitter disposed in a garage door opener).

The sensors coupled to interface 302 may include an engine control unit (ECU) 310, a field sensor 312, an environment sensor 314 (e.g., emission sensor, vibration sensor, temperature sensor), an RF sensor 316, a radar sensor 318, a sonar sensor 320, a camera 322, a photoelectric sensor 324, a global positioning system 326, or any other type of sensor capable of being disposed in or on vehicle 10. One or more of the sensors may be disposed in or on the vehicle and configured to provide data to processing electronics 304 via interface 302 for determining whether an engine is started, whether the vehicle is in the garage and whether the garage door is closed. Various sensors may be better suited for providing data for assisting in particular determinations. For example, ECU 310 (or other vehicle systems), field sensor 312 and environment sensor 314 may be ideally suited for providing data for determining whether an engine is started; environment sensor 314, RF sensor 316, radar sensor 318, sonar sensor 320, camera 322, photoelectric sensor 324 and global positioning system 326 may be ideally suited for providing data for determining whether vehicle 10 is in the garage; environment sensor 314, RF sensor 316, radar sensor 318, sonar sensor 320, camera 322, photoelectric sensor 324 may be ideally suited for providing data for determining whether the garage door is closed.

Figure 4B:
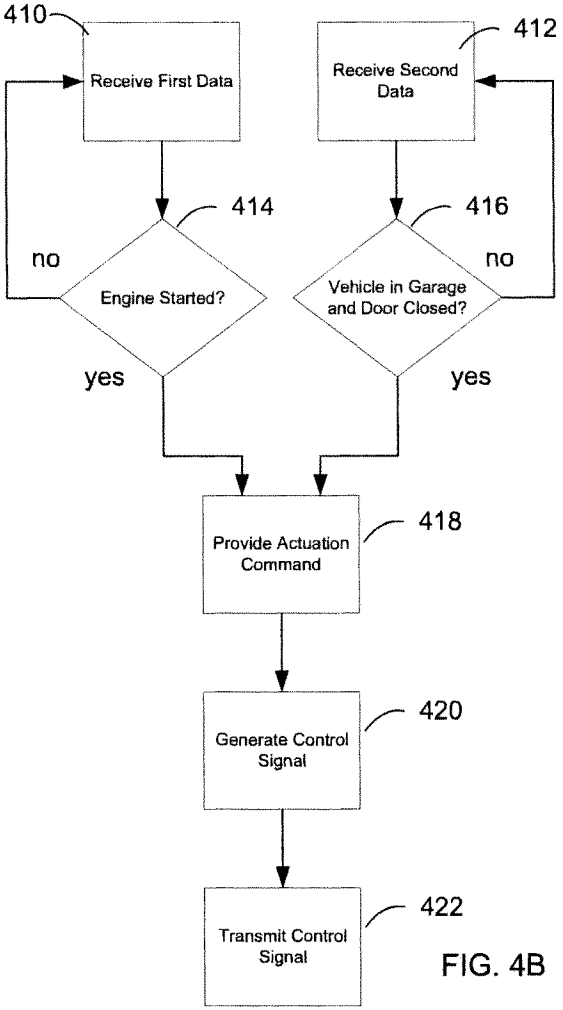
FIG. 4B is a flow diagram illustrating the steps taken by a control system in a vehicle to cause the garage door to actuate the garage door in accordance with an embodiment.
Figure 4A:
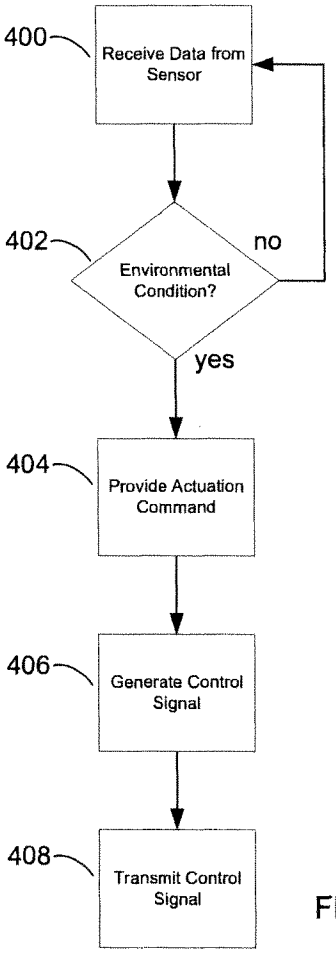
FIG. 4A is a flow diagram illustrating the steps taken by a control system in a vehicle to cause the garage door to actuate the garage door in accordance with an embodiment.

Referring to FIGS. 3 and 4A, in an exemplary embodiment, interface 302 is coupled to environment sensor 314. In step 400, processing electronics 304 disposed in vehicle 10 receives data from environment sensor 314 via interface 302 and, in step 402, uses the received data to determine whether an environmental condition exists. If the environmental condition does not exist, the processing electronics continues to receive and process data. If the data indicates that an environmental condition exists, then, in step 404, processing electronics 304 provides an actuation command to the transmitter 306 to generate a control signal formatted for recognition by a wireless receiver of the garage door opener 14 and to cause the garage door opener 14 to open the garage door 18. In step 406, the transmitter 306 generates the control signal in response to the actuation command. In step 408, the transmitter 306 transmits the control signal to the wireless receiver 16 of the garage door opener 14 in response to the command in order to cause the garage door to actuate.

As illustrated in FIG. 4A, vehicle 10 may be configured use an environment sensor 314 to sense an environmental condition and provide a control signal to cause an actuation the garage door in response to the sensed condition. Environment sensor 314 may include at least one of an emission sensor, a vibration sensor and a temperature sensor. A sensed environmental condition may indicate that a vehicle engine is started, that vehicle 10 is in the garage, and that the garage door is closed. For example, using an emission sensor, an environmental condition may be sensed when emission levels exceed a threshold. High emission levels would likely indicate that the vehicle engine is started because emission would otherwise be undetectable (assuming no other engines in the garage were started). High emission levels would likely indicate that the vehicle was in an enclosed area, such as a garage, where emissions would be at least partially contained. High emission levels would likely indicate that the garage door is closed because the high emission levels would be the result of little or no ventilation. Thus, data relating to an environmental condition may be all that is necessary to determine whether to actuate the garage door.

One type of environment sensor that may be used to determine whether the garage door should be actuated is an emission sensor disposed in or on vehicle 10 and configured to sense emission levels from vehicle 10. Emissions from vehicle 10 may include, hydrocarbons, Nitrogen oxides ($NO_x$), carbon monoxide (CO), carbon dioxide ($CO_2$), particulates, sulfur oxides ($SO_x$) and other air toxins. Emission sensor may be configured to sense one or more of these vehicle emissions to assist in determining whether the vehicle engine has been started. Emission sensor may be configured to provide data to processing electronics 304 via interface 302. Processing electronics 304 may be configured to determine that the vehicle is started when the sensed emission exceeds a threshold. Further, the emission sensor may be configured to sense at least one of these vehicle emissions to assist in determining whether the vehicle is in an enclosed area, such as the garage. In an enclosed area, the concentration of emission levels will be higher than if the vehicle were out side.

The emission sensor may be configured to provide a data to processing electronics 304 via interface 302. Processing electronics 304 may be configured to determine that the vehicle is in the garage when the sensed emission level exceeds a threshold. The emission sensor may be configured to sense one or more of these vehicle emissions to assist in determining whether the garage door is closed. The concentration of emission levels will be higher when the garage door is closed than if vehicle 10 were out side, or if vehicle 10 were in the garage with the garage door open. The emission sensor may be configured to provide data to interface 302 when the sensed emission exceeds a threshold. One or more threshold levels may be set to provide data to the interface 302 for the assisting in the various determinations (e.g., vehicle started, vehicle in garage and garage door closed). Ideally, the one or more thresholds would be set to a level that is not harmful to people and animals. Further, processing electronics 304 may be configured to identify differences in the received data to determine whether the strength of the emissions level indicates that the vehicle engine is started, that the vehicle engine is started and the vehicle is in the garage, or that the vehicle engine is started, in the garage and the garage door is closed.

Environment sensor 314 may also include a vibration sensor, such as an acoustic sensor or other type of mechanical vibration sensor, configured to sense vibration levels. The vibration sensor may be disposed in or on a vehicle and used to determine whether the garage door 18 should be actuated. When the engine of vehicle 10 is started, the engine produces vibrations that are transferred through the air and the structure of the vehicle. When the vehicle engine is turned off, no vibrations are produced. Vibration sensor may be configured sense the vibrations produced by the vehicle. Vibration sensor may be configured to provide data to processing electronics 304 via interface 302. Processing electronics 304 may be configured to determine that the vehicle is started when the sensed vibrations exceeds a threshold. When the vehicle is located in an enclosed area, such as the garage, the noise, or vibrations, from the idle engine will appear louder, or stronger, than if the vehicle 10 were outside. The vibrations from the engine are stronger in a garage than outside because the sound waves produced by the engine are reflected off the garage walls and ceiling back to the vehicle 10, whereas, outside the garage there are minimal reflections from the atmosphere and surrounding objects (e.g., buildings, trees). Thus, inside a garage, the strength of the vibrations will be greater than if the vehicle were out side.

The vibration sensor may be configured to provide data to processing electronics 304 via interface 302. Processing electronics 304 may be configured to determine that the vehicle is in the garage when the sensed vibration level exceeds a threshold. When vehicle 10 is located in a garage and the garage door 18 closed, the vibrations from the started engine will appear even stronger than if the vehicle 10 were in the garage with the garage door 18 open. The vibrations from the engine are stronger because the sound waves are reflected off the garage walls, ceiling and door back to the vehicle 10, whereas, when the garage door is open, some of the sound waves will escape through the garage door opening. The vibration sensor may be sensitive enough to detect differences in vibration strength when the garage door is closed as compared to open. The vibration sensor may be configured to provide data to processing electronics 304 via interface 302. Processing electronics 304 may be configured to determine that the garage door is closed when the sensed vibration level exceeds a threshold. One or more threshold levels may be set to provide data to the interface 302 for the assisting in the various determinations (e.g., vehicle started, vehicle in garage and garage door closed). Further, processing electronics 304 may be configured to identify differences in the received data to determine whether the strength of the vibration level indicates that the vehicle engine is started, that the vehicle engine is started and the vehicle is in the garage, or that the vehicle engine is started, in the garage and the garage door is closed.

Environment sensor 314 may also include a temperature sensor disposed in or on the vehicle 10 and configured to sense the temperature outside the vehicle 10 or the engine temperature. When the engine of vehicle 10 is started, the heat from the engine and exhaust increases the ambient temperature around the vehicle 10 and the temperature of the engine. Temperature sensor may be configured to provide data to processing electronics 304 via interface 302. Processing electronics 304 may be configured to determine that the vehicle is started when the sensed temperature around the vehicle 10 or of the engine exceeds a threshold. The engine temperature may also be monitored and provide by ECU 310 or any other type of temperature sensor coupled to the engine. When the engine of vehicle 10 is started and running in a garage, the heat from the engine and exhaust increase the ambient temperature of the garage. The temperature sensor may be configured to send data to processing electronics 304 via interface 302. Processing electronics 304 may be configured to determine that the vehicle is in the garage when the temperature sensed rises above a threshold. When the engine of vehicle 10 is started and in a garage with the garage door closed, the heat from the engine and exhaust increase the ambient temperature of the garage. The temperature level will be higher than if the vehicle were in the garage with the garage door open because an open garage door would allow the heat generated by the engine to escape through the garage door opening. Thus, the temperature sensor may be sensitive enough to detect differences in temperature when the garage door is closed as compared to open. The temperature sensor may be configured to provide data to processing electronics 304 via interface 302. Processing electronics 304 may be configured to determine that the garage door is closed when the sensed temperature exceeds a threshold. One or more threshold levels may be set to provide data to the interface 302 for the assisting in the various determinations (e.g., vehicle started, vehicle in garage and garage door closed).

Further, processing electronics 304 may be configured to identify differences in the received data to determine whether the temperature level indicates that the vehicle engine is started, that the vehicle engine is started and the vehicle is in the garage, or that the vehicle engine is started, in the garage and the garage door is closed. The thresholds may be set from a varying baseline temperature. The varying baseline temperature may be used to account for different seasons, times of the day or other changes in weather patterns. Processing electronics 304 may use various means and methods to establish a baseline temperature from which thresholds may be determined. For example, processing electronics 304 may be configured to access the internet via server 1146 coupled vehicle control system 1106 (see FIG. 11) to obtain current outside temperature information. GPS or other location systems may provide the location information needed when access the internet. Alternatively, location information (e.g., zip code) may be provided when the system is configured. Processing electronics 304 may also be configured to use historic data to determine a baseline temperature for a given day and hour.

Additional sensors may be used in conjunction with environment sensor 314 to assist processing electronics in determining whether the vehicle 10 is started, whether vehicle 10 is in the garage and/or whether the garage door is closed. For example, sensor(s) can be employed that more directly indicate whether the vehicle is started, whether the garage door is open or closed, and whether the vehicle is in the garage. For example, a sensor on the vehicle may indicate whether the vehicle is running, a sensor on the garage door opener may indicate whether the garage door is opened or closed, and a sensor on the vehicle or in the garage may indicate the location of the vehicle.

Alternatively, processing electronics 304 may be configured to simply detect a harmful, or near harmful, condition rather than attempting to determine that the vehicle is started and in the garage with the garage door closed. If emission levels or temperature levels in the garage exceed a threshold, the garage door may be actuated irrespective of whether the vehicle engine is started. For example, a combustion engine electrical power generator, or a vehicle without emergency garage door actuation capability, may be started in the same garage as vehicle 10. If processing electronics 304 sense emission or temperature levels above the thresholds then processing electronics 304 may be configured to provide an actuation command to transmitter 306 to send a control signal to the garage door opener 14 in order to cause the garage door to open and provide needed ventilation.

Referring to FIGS. 3 and 4B, in an exemplary embodiment, interface 302 is coupled to at least one sensor. In step 410, processing electronics 304 disposed in vehicle 10 receives data from a sensor or vehicle system via interface 302, and uses the received data in step 414 to determine whether the vehicle engine is started. If processing electronics determines that the engine has not started then processing electronics continues to receive and process data. In step 412, processing electronics 304 disposed in vehicle 10 receives data from one or more sensors. In step 416, processing electronics 304 uses the received data to determine whether the vehicle 10 is in the garage and whether the garage door is closed. If processing electronics determines that the vehicle is not in the garage or that the garage door is open then processing electronics continues to receive and process data. If processing electronics 304 determines that the vehicle 10 is started, vehicle 10 is in the garage and that the garage door is closed, then in step 418, processing electronics is configured to provide an actuation command to transmitter 306 to generate a control signal formatted for recognition by a wireless receiver of the garage door opener 14 and to cause the garage door opener 14 to open the garage door 18. In step 420, the transmitter 306 generates the control signal in response to the actuation command. In step 422, the transmitter 306 transmits the control signal to the wireless receiver 16 of the garage door opener 14 in response to the command in order to cause the garage door to actuate.

Various sensors and combinations of sensor may be used by vehicle 10 to determine whether to provide a control signal to cause an actuation of the garage door in response to the data received from the sensor. As mentioned above, the sensors coupled to interface 302 may include an engine control unit (ECU) 310, a field sensor 312, an environment sensor 314, an RF sensor 316, a radar sensor 318, a sonar sensor 320, a camera 322, a photoelectric sensor 324, a global positioning system 326, or any other type of sensor capable of being disposed in or on vehicle 10.

In an exemplary embodiment, one or more of an ECU 310, a field sensor 312, and an environment sensor 314 may be used to assist processing electronics 304 in determining whether the vehicle engine is started. Further, any other vehicle system, component or sensor capable of providing data related to the state or condition of the engine may be coupled to interface 302 and configured to provide data to processing electronics 304 via interface 302 for determining whether vehicle engine is started.

ECU 310 may be coupled to interface 302 and configured to provide data with respect to the state, condition or operation of the vehicle's engine. The ECU 310 may be configured to sense whether the engine is started or sense conditions that would indicate that the engine is started, such as engine temperature or oil pressure. The data from ECU 310 is provided to processing electronics 304 via interface 302 and processed to determine whether vehicle engine is started.

Field sensor 312 may be coupled to interface 302 and configured to provide data with respect to the fields generated by the vehicle 10. Field sensor may include magnetic sensors and inductive field sensors or any other type of field sensor capable of being disposed in or on vehicle 10. When a vehicle engine is started there is a change in the magnetic and inductive fields produced by vehicle 10, which can be detected by magnetic and inductive sensors. Field sensor 312 may be configured to sense the field changes and provide data to processing electronics 304 via interface 302 for determining whether vehicle engine is started. Processing electronics 304 may be configured to determine that the vehicle engine is started when the sensed fields exceed a threshold. Measured aspects of the field may include field strength, field direction, or other sensed field characteristics. Field sensor 312 may be part of a sensor kit that can be manually disposed in or on vehicle 10, or vehicle 10 may come equipped from the manufacturer with field sensor 312. Field sensor 312 may be a preexisting vehicle component, such as a vehicle compass. A vehicle compass may be configured to sense change in magnetic field when the engine is started and provide data to processing electronics 304 via interface 302 for determining whether vehicle engine is started.

Environment sensor 314 may be coupled to interface 302 and configured to provide data with respect to an sensed environmental condition. As discussed above, environment sensor may include an emissions sensor, a vibration sensor and a temperature sensor. Emission sensor may be configured to provide emissions data to processing electronics 304 via interface 302 to assist in determining whether the vehicle engine is started. Vibration sensor may be configured to provide vibration data to processing electronics 304 via interface 302 to assist in determining whether the vehicle engine is started. Temperature sensor may be configured to provide temperature data to processing electronics 304 via interface 302 to assist in determining whether the vehicle engine is started.

Furthermore, various sensors may provide data sufficient to also indicate whether vehicle 10 is in the garage or whether the garage door is closed. For example, emission levels detected above a certain level by an emission sensor may indicate not only that the engine is likely started, but that vehicle 10 is in an enclosed space (e.g., the garage) and that the garage door is closed. Thus, while it may be desirable to include other sensors to provide various additional data, in may be unnecessary when certain sensors are used by vehicle 10. However, it may be desirable to receive data from various sensors to ensure that the garage door is properly actuated. For example, if data from ECU 310 were the only sensor used to determine whether the vehicle was started and no determination was required as to whether vehicle 10 is in the garage, then a vehicle that is started, either manually, remotely or automatically, outside the garage (e.g., in the driveway) would unnecessarily actuate the garage door. Furthermore, vehicle 10 started in the garage with the garage door open would unnecessarily close the garage door and create a potentially harmful environment inside the garage. Various sensors could be used in combination to provide more accurate or complete data. For example, ECU 310 could be used in conjunction with emission sensor. Emission sensor may be used to sense high emission levels and provide data indicating that undesirable environmental conditions are in a garage and that the garage door is closed. ECU 310 may provide data for determining that the vehicle's engine is started.

In an exemplary embodiment, one or more of an environment sensor 314, an RF sensor 316, a radar sensor 318, a sonar sensor 320, a camera 322, a photoelectric sensor 324, a global positioning system (GPS) 326, or any other type of sensor capable of being disposed in or on vehicle 10 may be used to assist processing electronics 304 in determining whether the vehicle is in the garage and whether the garage door is closed.

Environment sensor 314 may be coupled to interface 302 and configured to provide data with respect to an sensed environmental condition. As discussed above, environment sensor may include an emissions sensor, a vibration sensor and a temperature sensor.

Emission sensor may be configured to provide emissions data to processing electronics 304 via interface 302 to assist in determining whether the vehicle 10 is in the garage. Emissions from vehicle 10 may include, hydrocarbons, Nitrogen oxides ($NO_x$), carbon monoxide (CO), carbon dioxide ($CO_2$), particulates, sulfur oxides ($SO_x$) and other air toxins. The emission sensor may be configured to sense at least one of these vehicle emissions to provide data to processing electronics 304 via interface 302 to assist in determining whether the vehicle is in an enclosed area, such as the garage. In an enclosed area, the concentration of emission levels will be higher than if the vehicle were out side. The emission sensor may be configured to provide a data to processing electronics 304 via interface 302. Processing electronics 304 may be configured to determine that the vehicle is in the garage when the sensed emission level exceeds a threshold. The emission sensor may be configured to sense one or more of these vehicle emissions to provide data to processing electronics 304 via interface 302 to assist in determining whether the vehicle 10 is in a garage with a closed door. In a closed garage, the concentration of emission levels will be higher than if vehicle 10 were out side, or if vehicle 10 were in the garage with the garage door open. Ideally, the threshold is set to a level that is not harmful to people and animals.

The vibration sensor may include an acoustic sensor or other type of mechanical vibration sensor. When the vehicle is located in an enclosed area, such as the garage, the noise from the idle engine will appear louder than if it were outside. The noise from the engine is louder because the sound waves are reflected off the garage walls and ceiling back to the vehicle, whereas, outside the garage there are minimal reflections from the atmosphere and surrounding objects (e.g., buildings, trees). The vibration sensor may be configured to provide data to processing electronics 304 via interface 302 to assist in determining whether vehicle 10 is in the garage when the sensed vibrations from the reflected sound waves exceed a threshold. When vehicle 10 is located in a garage with the garage door closed, the noise from the started engine will appear louder than if it were outside or in the garage with the garage door open. The noise from the engine is louder because the sound waves are reflected off the garage walls, door and ceiling back to the vehicle, whereas, outside the garage there are minimal acoustic reflections from the atmosphere and surrounding objects (e.g., buildings, trees). The vibration sensor may be configured to be sensitive enough to detect differences in noise level when the garage door is closed as compared to open. The vibration sensor may be configured to provide data to processing electronics 304 via interface 302 to assist in determining whether the garage door is closed when the sensed vibrations from the reflected sound waves exceed a threshold.

The temperature sensor may be configured to monitor the ambient temperature outside of the vehicle. When the engine of vehicle 10 is started and running in an enclosed garage, the heat from the engine and exhaust increase the ambient temperature of the garage. The temperature sensor may be configured to provide data to processing electronics 304 via interface 302 to assist in determining whether vehicle 10 is in the garage when the sensed temperature exceeds a threshold. When the engine of vehicle 10 is started and running in a garage and the garage door closed, the heat from the engine and the exhaust trapped in the garage increase the ambient temperature of the garage. The temperature sensor may be configured to provide data to processing electronics 304 via interface 302 to assist in determining whether the garage door is closed when the sensed temperature exceeds a threshold. The thresholds for determining whether the vehicle is in the garage and whether the garage door is closed may be different thresholds. As discussed above, processing electronics may utilizes various means and methods to determine a baseline temperature for setting thresholds. Some factors in determining the baseline temperature may include time of year, time of day, location, historic weather patterns, and current outside temperature. Processing electronics may obtain data from a variety of sources, including an internal clock or calendar system, a navigational system or device and a server 1146.

RF sensor 316 may be coupled to interface 302 and configured to provide data with respect to the surroundings of vehicle 10. RF sensor 316 may be mounted on or built into a vehicle. Processing electronics 304 may be configured to use data received from RF sensor 316 via interface 302 to determine whether vehicle 10 is located in an enclosed area, such as a garage. RF sensor 316 may be used to determine distances to objects by providing data for measuring the strength of the reflections from objects resulting from a transmitted RF signal. RF sensor 316 may be configured to assist processing electronics 304 in determining distance by providing data for measuring the time from transmission to return of the reflection. Processing electronics 304 may be configured to determine distance to an object using the strength of the reflected signal and comparing that to the strength of the transmitted signal. Processing electronics 304 may be configured to use both time and signal strength to determine distance. The vehicle owner may also place RF reflectors or other kinds of RF ID tags in the garage to assist in determining that vehicle 10 is in the garage. Reflectors or RF ID tags may be beneficial in improving detection because certain materials used in construction may not serve as good RF reflectors. The reflectors or tags may also server to uniquely identify the garage, or even the particular stall in which vehicle 10 is parked.

Processing electronics 304 may be configured to use data received from RF sensor 316 via interface 302 to determine whether the garage door 18 is closed. RF sensor 316 may be used to assist processing electronics 304 in determining whether the garage door is closed by transmitting a signal in the direction of the garage door opening. If the garage door is closed, processing electronics 304 will be able to determine the distance from vehicle 10 to the garage door using the data received from RF sensor 316. If the distance is below a threshold, processing electronics may determine that the garage door 18 is closed. If the garage door is open, the signal will pass through the garage door opening and reflect off objects outside the garage. The objects detected outside of the garage will appear relatively far away and processing electronics 304 will be able to determine that the door is open. RF sensor 316 may also be directed toward the ceiling to assist in determining whether the garage door is in an open or closed position. If the garage door is open, the door will be above vehicle 10 parked in the garage and the distance measured will be relatively small. If the garage is closed, the door will be behind vehicle 10 and the distance measured will be larger because the signal will reach the ceiling. The vehicle owner may also place RF reflectors or other kinds of RF ID tags on the garage door, or garage ceiling above the vehicle, to assist in determining whether the garage door is closed. The reflectors, or RF ID tags, may be beneficial in improving detection because certain materials used in construction may not serve as good RF reflectors.

Radar sensor 318 may be coupled to interface 302 and configured to provide data with respect to the surroundings of vehicle 10. Radar sensor 318 may be mounted on or built into a vehicle. Processing electronics 304 may be configured to use data received from radar sensor 318 via interface 302 to determine whether vehicle 10 is located in an enclosed area, such as a garage. Radar sensor 318 may be configured to detect distances to objects. Data from radar sensor 318 may be used by processing electronics 304 to determine whether vehicle 10 is in the garage by detecting the distances from vehicle 10 to the garage walls. Processing electronics may also include a memory configured to store radar data (e.g., a "radar map" of the garage) and compare subsequent radar measurements with the stored data to determine whether vehicle 10 is in the garage. The vehicle owner may also place reflectors or other types of objects in the garage to allow the processing electronics 304, using the radar sensor, to uniquely identify the garage area or to simply improve detection. The reflectors may be beneficial in improving detection because certain materials used in construction may not serve as good radar reflectors.

The radar signal emitted from radar sensor 318 may be adversely affected by the electromagnetic radiation of the engine, various electrical components, and wiring of vehicle 10. Various known methods may be implemented to reduce, filter or offset these effects. Furthermore, the electromagnetic radiation will always be present if the measurements are taken while the engine is started. Thus, while the electromagnetic radiation may reduce the sensitivity of the radar sensor 318, it may not cripple the ability of processing electronic 304 to perform its function of determining whether vehicle 10 is in a garage. Alternatively, radar sensor 318 may be configured to briefly turn on after vehicle 10 shuts down in order to avoid disturbance from the engine. If the last measurement taken indicated that vehicle 10 was in the garage, then it could be assumed that upon the next start up of the engine, before vehicle 10 is placed in motion, that vehicle 10 is still located in the garage.

Processing electronics 304 may be configured to use data received from radar sensor 318 via interface 302 to determine whether the garage door 18 is closed. Radar sensor 318 may be configured to detect distances to objects. Data from radar sensor 318 may be used by processing electronics 304 to determine whether the garage door is closed by transmitting a radar signal in the direction of the garage door opening. If the garage door is closed, processing electronics 304 will receive data indicating a distance from vehicle 10 to the closed garage door. If the distance determined is below a threshold, processing electronics 304 may determine that the garage door 18 is closed. If the garage door is open, the radar signal will pass through the garage door opening and reflect off objects outside the garage. The objects detected outside of the garage will appear relatively far away (e.g., above the threshold) and processing electronics 304 will be able to determine that the door is open.

The vehicle owner may also place reflectors or other types of objects on the garage door, or the portion of the garage ceiling covered by the garage door when in an open position, to enhance detection of a closed garage door. If the reflector or tag is placed on the door, then the processing electronics 304 may be able to determine the position of the door because the tag location would be above vehicle 10 when the door is open and behind vehicle 10 when the door is closed. The reflectors may be beneficial in improving detection because certain materials used in construction may not serve as good radar reflectors. Radar sensor 318 may also be directed toward the garage ceiling to assist in determining whether the garage door is in an open or closed position. When the garage door 18 is closed, the distance determine will be the distance to the ceiling and when the garage door 18 is open, the distance determined will be the distance to the garage door in open position. The distance to the garage door in open position will be less than the distance to the ceiling when the garage door is closed. Thus, processing electronics 304 may determine an open and closed garage door position when vehicle 10 is in the garage. Further, the inside of the garage door may include reflectors to enhance detection. Alternatively, the garage ceiling may include reflectors to enhance detection.

Sonar sensor 320 may be coupled to interface 302 and configured to provide data with respect to the surroundings of vehicle 10. Sonar sensor 320 may be mounted on or built into a vehicle. Processing electronics 304 may be configured to use data received from sonar sensor 320 via interface 302 to determine whether vehicle 10 is located in an enclosed area, such as a garage. Sonar sensor 320 may be configured to detect distances to objects. Data from sonar sensor 320 may be used by processing electronics 304 to determine whether vehicle 10 is in the garage by detecting the distances from vehicle 10 to the garage walls. Processing electronics may also include a memory configured to store sonar data (e.g., a "sonar map" of the garage) and compare subsequent sonar measurements with the stored data to determine whether vehicle 10 is in the garage. The sonar signal emitted from sonar sensor 320 may be adversely affected by the acoustic vibrations, or other effects, from the engine. Various known methods may be implemented to reduce, filter or offset these effects. Furthermore, the noise from the engine will always be present if the measurements are taken while the engine is started. Thus, while the noise may reduce the sensitivity of the sonar sensor 320, it may not cripple the ability of processing electronic 304 to perform its function of determining whether the vehicle 10 is in a garage. Alternatively, sonar sensor 320 may be configured to briefly turn on after vehicle 10 shuts down to avoid disturbance from the engine. If the last measurement taken indicated that vehicle 10 was in the garage, then it could be assumed that upon the next start up of the engine, before vehicle 10 is placed in motion, that vehicle 10 is still located in the garage.

Processing electronics 304 may be configured to use data received from sonar sensor 320 via interface 302 to determine whether the garage door is closed. Sonar sensor 320 may be configured to detect distances to objects. Data from sonar sensor 320 may be used by processing electronics 304 to determine whether the garage door is closed by transmitting a sonar signal in the direction of the garage door opening. If the garage door is closed, processing electronics 304 will receive data indicating a distance from vehicle 10 to the closed garage door. If the distance determined is below a threshold, processing electronics 304 may determine that the garage door 18 is closed. If the garage door is open, the sonar signal will pass through the garage door opening and reflect off objects outside the garage. The objects detected outside of the garage will appear relatively far away (e.g., above the threshold) and processing electronics 304 will be able to determine that the door is open.

Camera 322 may be coupled to interface 302 and configured to provide data with respect to the surroundings of vehicle 10. Camera 322 may be a camera mounted on, or built into, the vehicle bumper and coupled to a display to provide the user with a bumper level perspective of the vehicle's surroundings. Camera 322 may include cameras mounted on, or built into, other portions of vehicle 10. Camera 322 may provide data to processing electronics 304 via interface 302 to assist in determining whether vehicle 10 is located in the garage. Processing electronics 304 may be configured to process the data received from camera 322 using various pattern recognition and image processing techniques. Using various image processing techniques, processing electronics 304 may be able to identify and recognize certain aspects of the garage, such as color, shape, shading, brightness, darkness, contrasting colors, shape sizes, etc. The user may enhance the ability of processing electronics 304 to uniquely recognize the garage by including stickers, markers, objects or other items in the garage.

Camera 322 may provide data to processing electronics 304 via interface 302 to assist in determining whether the garage door is closed. Camera 322 may be positioned in the direction of the door in relation to the position of vehicle 10 parked in the garage. For example, a rear bumper camera may face the garage door if vehicle 64 enters the garage front first. Camera 322 may be configured to provide data to determine whether the garage door is closed by focusing in on the door or recognizing a characteristic of the door when the door is visible to the camera 322 (e.g., only visible in the closed position). The user may provide stickers, colors, patterns, symbols, markers, etc on the garage door to enhance the ability of camera 322 to provide data identifying a garage door position (e.g., open or closed). Camera 322 may also be directed toward the ceiling to assist in determining whether the door is open or closed. When the garage door is open the distance detected will be to the garage door positioned above vehicle 10 in the open position. The garage door 18 may be configured with stickers, colors, patterns, symbols, markers, etc., so that processing electronics 304 recognizes that the door is in the open position when camera 322 is directed toward the garage ceiling. When the garage door is closed the distance detected will be to the ceiling and processing electronics 304 will not see any stickers, colors, patterns, symbols, markers, etc. Thus, processing electronics, using camera 322, will be able to determine that the garage door is closed. Alternatively, the stickers, colors, patterns, symbols, markers, etc., may be placed on the ceiling so that when the stickers, colors, patterns, symbols, markers, etc., are seen by processing electronics 304 using data from camera 322, a determination that the garage door is closed may be made. Either the ceiling or the door may contain the markers, patterns, colors, etc., to enhance the determination of whether the door is closed.

Photoelectric sensor 324 may be coupled to interface 302 and configured to provide data with respect to the surroundings of vehicle 10. Photoelectric sensor 324 may be mounted on or built into a vehicle 10. Photoelectric sensors 324 may include sensors that use Infrared (IR), visible red, laser, UV or any other type of light. Similar to radar and sonar, photoelectric sensor 324 may be configured to detect distances to objects. Processing electronics 304 may be configured to use data received from photoelectric sensor 324 via interface 302 to determine whether vehicle 10 is located in an enclosed area, such as a garage. Data from photoelectric sensor 324 may be used by processing electronics 304 to determine whether vehicle 10 is in the garage by detecting distances from vehicle 10 to the garage walls. Processing electronics 304 may also include a memory configured to store distance measurements taken in the garage and to compare subsequent measurements with the stored measurements to determine whether vehicle 10 is likely in the garage. The vehicle owner may also place reflectors or other types of objects in the garage to allow the processing electronics 304, using the photoelectric sensor, to uniquely identify the garage area or to simply improve detection.

Processing electronics 304 may be configured to use data received from photoelectric sensor 324 via interface 302 to determine whether the garage door is closed. Photoelectric sensor 324 may be used to assist in determining whether the garage door is closed by transmitting a signal in the direction of the garage door opening. If the garage door is closed, processing electronics 304 will receive data indicating a distance from vehicle 10 to the closed garage door. If the distance determined is below a threshold, processing electronics 304 may determine that the garage door 18 is closed. If the garage door is open, the signal will pass through the garage door opening and reflect off objects outside the garage. The objects detected outside of the garage will appear relatively far away (e.g., above the threshold) and processing electronics 304 will be able to determine that the door is open. The photoelectric sensor 324 may also be directed toward the ceiling to assist in determining whether the garage door is in an open or closed position. When the garage door 18 is closed, the distance determine will be the distance to the ceiling and when the garage door 18 is open, the distance determined will be the distance to the garage door in open position. The distance to the garage door in open position will be less than the distance to the ceiling when the garage door is closed. Thus, processing electronics 304 may determine an open and closed garage door position when vehicle 10 is in the garage.

The user may also use stickers, paint, reflectors, or other items in conjunction with the various types of photoelectric sensors. For example, the user could put special UV paint or stickers on the garage ceiling or garage door to reflect UV light from a UV sensor disposed in vehicle 10 to assist in determining whether the garage door is closed. If the UV sensor is directed toward the ceiling and the reflector is place on the ceiling, a closed garage door position may be detected if the reflector is identified as being above vehicle 10 (e.g., the garage door is not blocking the view of the reflector because the garage door is in the closed position). If the UV sensor is directed toward the ceiling and the reflector is place on the garage door, an open garage door position may be detected if the reflector is identified as being above vehicle 10 (e.g., the reflector is visible because the garage door is in the open position above the vehicle). If the UV sensor is directed toward the garage door opening and the reflector is place on the garage door, a closed garage door position may be detected if the reflector is identified (e.g., the reflector is visible only when the garage door is in the closed position). Other types of light signals and corresponding reflective items (e.g., stickers, paint, reflectors) could be used in various configurations to assist processing electronics 304 in determining whether the door is closed.

Global Positioning System (GPS) 326 may be coupled to interface 302 and configured to provide data with respect to the location of vehicle 10. GPS 326 may be mounted on or built into a vehicle. Processing electronics 304 may be configured to use data received from GPS 326 via interface 302 to determine whether vehicle 10 is located in the garage. GPS 326 may be configured to assist in determining the current location of vehicle 10 and to store locations of interest. Alternatively, locations of interest may be stored in memory coupled to processing electronics 304. For purposes of determining whether vehicle 10 is in the garage, the location of interest may be the location of the garage or the location of the garage opening. The location of the garage opening may be beneficial to use because GPS 58 may not be able to communicate with satellites while in the garage. GPS 58 and/or processing electronics 304 may be configured to determine that vehicle 10 is in the garage when vehicle 10 reaches the opening of the garage door (may be a location of interest) and then loses the communication signal while the vehicle is still started. GPS 58, alone or in conjunction with other vehicle systems coupled processing electronics 304 may be able to determine the speed, the acceleration/deceleration and direction of vehicle 10 at the opening of the garage door to determine where vehicle 10 would come to rest. GPS 58 and/or processing electronics 304 may be configured to determine that vehicle 10 is in the garage using other techniques, such as dead reckoning, which is used to estimate the current vehicle location when a GPS signal is lost or unavailable. Dead reckoning may utilize components, such as the vehicle compass system, the speedometer and the odometer. When the GPS signal is lost, dead reckoning may use the compass and speed/distance to approximate a location.

While the different types of sensors and systems for sensing have been discussed individually, it is to be understood that the sensors and systems may be used in various combinations to determine whether vehicle 10 is in the garage and whether the garage door is closed. For example, GPS 326 may be used in conjunction with photoelectric sensor 324 and environment sensor 314 to increase the probability of an accurate determination by processing electronics 304. Other types of sensors may be used by vehicle 10 to assist in determining whether the vehicle 10 is in the garage and whether the garage door is closed.

A determination by processing electronics 304 to provide an actuation command may be made using data from one or more sensors coupled to interface 302. The number of sensors needed to make a proper determination to provide an actuation command will depend upon which types of sensors, or combinations of sensors, are used. Furthermore, the number of sensors will depend on how sensitive the various types of sensors are. For example, processing electronics 304 may be configured to provide an actuation command in response to data from an environment sensor detecting emission levels above a threshold. If emission levels are above a threshold, it may be assumed that vehicle 10 is started, that vehicle 10 is located in the garage, and that the garage door is closed. Thus, an emission sensor may be the only sensor required to determine whether an actuation command may be generated. Other sensors may be used to ensure that the garage door is properly actuated, such as GPS 326, to assist in determining that the vehicle is in the garage, or a proximity sensor (radar sensor 318, sonar sensor 320, photoelectric sensor 324 or RF sensor 316) configured to assist in determining that the garage door 18 is closed.

With respect to vibration sensor, it may not be appropriate to determine whether to provide an actuation command based solely on the data from the vibration sensor if the garage is located near an airport, railway, is in a location with frequent earthquakes or located near a highway. However, under some circumstances it may be appropriate if, for example, the vibration sensor were sensitive enough to be able to provide data that processing electronics could use to distinguish between vibrations in a garage with the garage door closed and a garage with the garage door open. Other sensors may be required in addition to ECU 310 to assist processing electronics 304 in determining whether vehicle 10 is located in a garage and whether the garage door is closed. Activation of the garage door as a result of solely using data provided by ECU 310 (e.g., used to determine whether the engine is started) may result in actuating the garage door when vehicle 10 is idling in the driveway and may even close the garage door on vehicle 10 when it is started in the garage, thereby resulting in a potentially harmful situation. Thus, additional sensors, such as radar, sonar, photoelectric, RF, GPS, etc., would be helpful in determining whether to open the garage door. Various combinations of sensors could be used to assist in determining whether an actuation command should be provided for actuation of the garage door 18.

Emergency Actuation Determined by the Garage Door Opener

Figure 5:
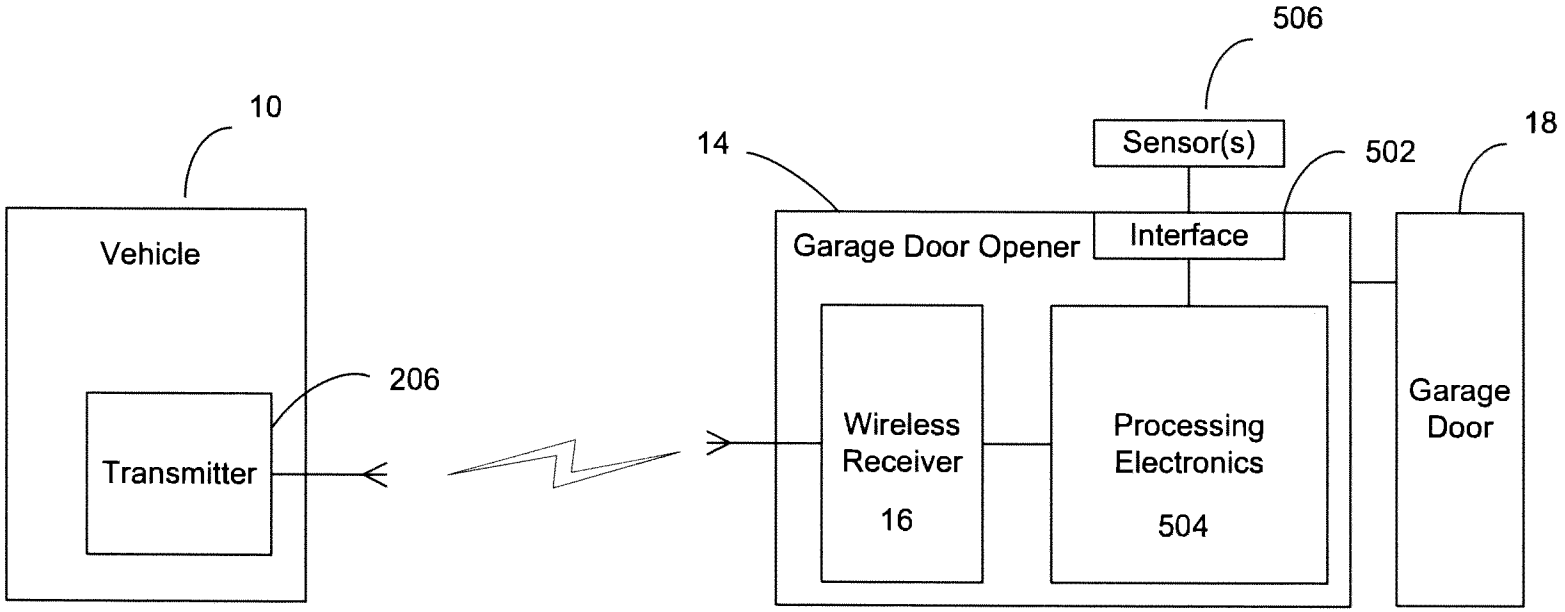
FIG. 5 is a schematic block diagram of an garage door opener configured to determine conditions for actuating a garage door in accordance with an embodiment.

Referring to FIG. 5, in an exemplary embodiment, garage door opener 14 may be configured to open a garage door 18 and may include a wireless receiver for receiving a control signal. Garage door opener 14 may include an interface 502, processing electronics 504 and a wireless receiver 16. Interface 502 may be coupled to at least one sensor 506 and configured to receive data from at least one sensor(s) 506. Processing electronics 504 may be coupled to interface 502 and configured to receive the data from interface 502. Sensor 506 may be coupled to the interface 502 via a physical or wireless communication connection. If the communication connection is wireless, interface 502 may include wireless electronics (e.g., transmitter and receiver) to communicate with sensor 506. Interface 502 and sensor 506 may be configured to communicate wirelessly using any type of wireless communication. For example, interface 502 and sensor 506 may be configured to communicate using an IEEE 802.11 connection, and IEEE 802.15 connection, a Bluetooth® connection, a WiFi connection, a WiMax connection, cellular signal, a signal using Shared Wireless Access Protocol-Cord Access (SWAP-CA) protocol, or any other type of RF or wireless signal. An IEEE 802.15 connection includes any wireless personal area networks (WPAN), such as ZigBee, Z-Wave, Bluetooth, UWB, and IrDA. Processing electronics 504 may be configured to use the data to determine whether an environmental condition exists, whether a vehicle engine is started, whether vehicle 10 is in the garage and whether the garage door is closed. Processing electronics 504 may be configured to provide a command to the garage door opener 14 to actuate the garage door based on the determination of whether an environmental condition exists. Further, processing electronics 504 may be configured to provide a command to the garage door opener 14 to actuate the garage door based on the determination of whether vehicle 10 is in the garage and whether the garage door is closed. In response to the command signal, the garage door is opened. Alternatively, processing electronics 504 may be provided outside of garage door opener 14 as one or more separate units or processing electronics 504 may be provided in sensor 506. In this embodiment, processing electronics 504 may be coupled to the interface 502 via a physical or wireless communication connection. If the communication connection is wireless, interface 502 may include wireless electronics (e.g., transmitter and receiver) to communicate with sensor 506.

Furthermore, garage door opener 14 may be configured to receive control signals from remote one or more remote transmitters. For example, vehicle 10 may include a transmitter 206 configured to provide an appropriately formatted control signal to the wireless receiver 16. The control signal may be configured to cause the garage door opener 14 to actuate the garage door 18.

Figure 6:
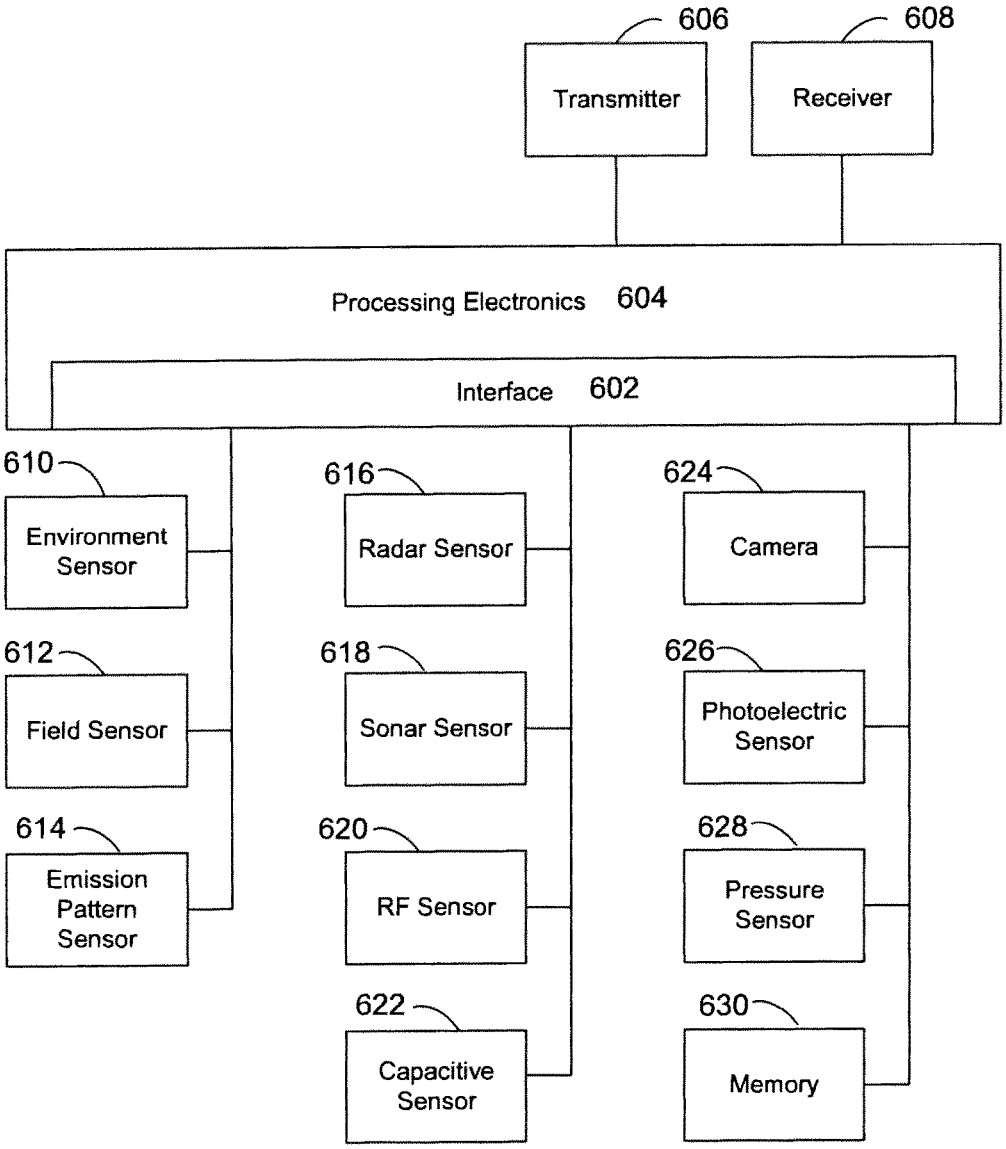
FIG. 6 is a schematic block diagram of sensors coupled to a garage door opener configured to determine conditions for actuating a garage door in accordance with an embodiment.

Referring to FIG. 6, various types of sensors may be coupled to interface 602 of garage door opener 14. Interface 602 is coupled to processing electronics 604 and communicates data from the various sensors to processing electronics 604. Transmitter 606 is coupled to processing electronics 604 and may be configured to provide data to vehicle 10. Wireless receiver 608 is coupled to processing electronics 604 and configured to receive an appropriately formatted control signal from a remote transmitter 206.

The sensors coupled to interface 602 may include an environment sensor 610 (e.g., emission sensor, vibration sensor, temperature sensor), a field sensor 612, an emission pattern sensor 614, a radar sensor 616, a sonar sensor 618, an RF sensor 620, a capacitive sensor 622, a camera 624, a photoelectric sensor 626, a pressure sensor 628, a memory 630, or any other type of sensor capable of being disposed in a garage or garage door opener 14. One or more of the sensors may be disposed in the garage and configured to provide data to processing electronics 604 via interface 602 for determining whether an engine is started, whether the vehicle is in the garage and whether the garage door is closed. Alternatively, one or more sensors may provide data to processing electronics 604 for determining whether an environmental condition exists. Various sensors may be better suited for providing data for assisting in particular determinations. For example, field sensor 612 and environment sensor 610 may be ideally suited for providing data for determining whether an engine is started; environment sensor 610, field sensor 612, emission pattern sensor 614, radar sensor 616, sonar sensor 618, RF sensor 620, capacitive sensor 622, camera 624, photoelectric sensor 626, or pressure sensor 628 may be ideally suited for providing data for determining whether vehicle 10 is in the garage; environment sensor 610, field sensor 612, radar sensor 616, sonar sensor 618, RF sensor 620, capacitive sensor 622, camera 624, photoelectric sensor 626, or memory 630 may be ideally suited for providing data for determining whether the garage door is closed.

Figure 7B:
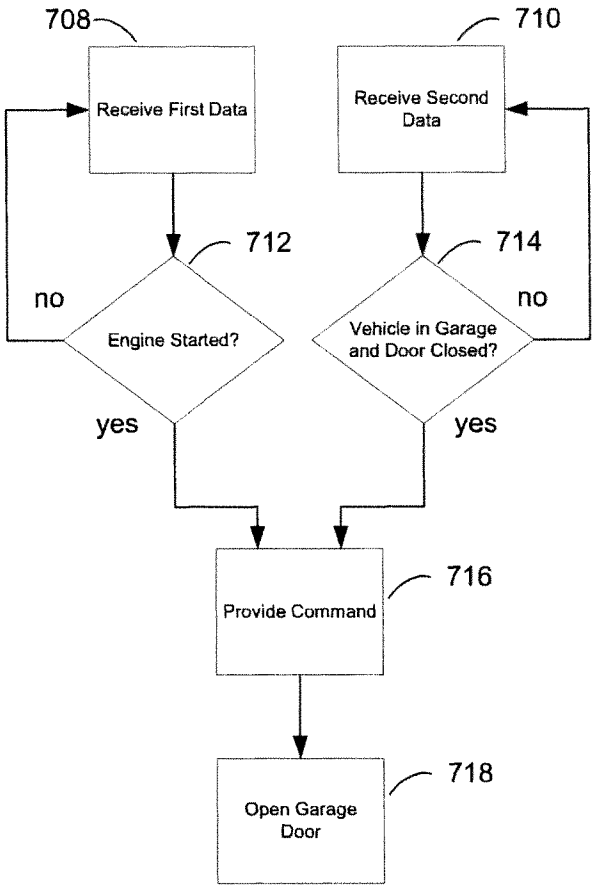
FIG. 7B is a flow diagram illustrating the steps taken by a garage door opener to cause the garage door opener to actuate the garage door in response to sensed conditions in accordance with an embodiment.
Figure 7A:
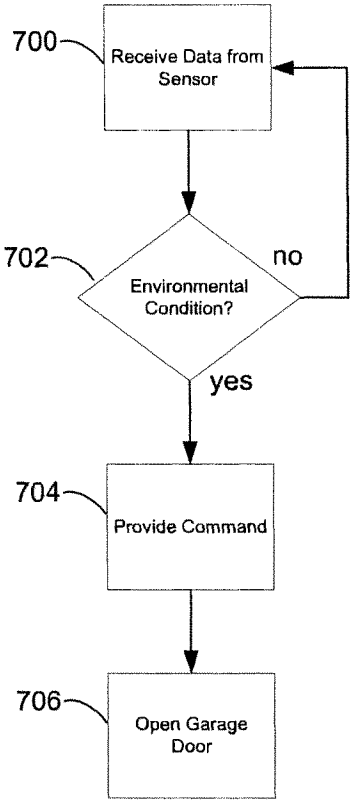
FIG. 7A is a flow diagram illustrating the steps taken by a garage door opener to cause the garage door opener to actuate the garage door in response to sensed conditions in accordance with an embodiment.

Referring to FIGS. 6 and 7A, in an exemplary embodiment, environment sensor 610 is coupled to interface 602. In step 700, processing electronics 604 disposed in garage door opener 14 receives data from environment sensor 610 via interface 602 and, in step 702, uses the received data to determine whether an environmental condition exists. If the environmental condition does not exist, the processing electronics continues to receive and process data. If the data indicates that an environmental condition exists, then, in step 704, processing electronics 604 provides a command to cause the garage door opener to open the garage door 18. The command is provided based on the determination of whether the environmental condition exists. In step 706, the garage door opener 14 opens the garage door 18 in response to the command.

As illustrated in FIG. 7A, vehicle 10 may be configured use an environment sensor 610 to sense an environmental condition and provide a command to cause an actuation the garage door in response to the sensed condition. Environment sensor 610 may include at least one of an emission sensor, a vibration sensor and a temperature sensor. A sensed environmental condition may indicate that a vehicle engine is started, that vehicle 10 is in the garage, and that the garage door 18 is closed. For example, using an emission sensor, an environmental condition may be sensed when emission levels exceed a threshold. High emission levels would likely indicate that the vehicle engine is started because emissions would otherwise be undetectable if the vehicle engine was off (assuming no other engines in the garage were started). High emission levels would likely indicate that the vehicle was in the garage, where emissions would be at least partially contained. High emission levels would likely indicate that the garage door is closed because the high emission levels would be the result of little or no ventilation. Thus, data relating to an environmental condition may be all that is necessary to determine whether to actuate the garage door.

Environment sensor 610 may be configured to monitor various aspects of the garage environment to determine whether a combustion engine has been started, such as vehicle emissions, vibrations or temperature. Emission sensor may be disposed in the garage and configured to sense emission levels from vehicle 10. Emissions from a combustion engine may include, hydrocarbons, Nitrogen oxides ($NO_x$), carbon monoxide (CO), carbon dioxide ($CO_2$), particulates, sulfur oxides ($SO_x$) and other air toxins. An emission sensor may be configured to sense one or more of these emissions to assist processing electronics 604 in determining whether the engine has been started. In an enclosed area, emission levels will be higher than if the engine were out side. Processing electronics 604 may be configured to determine that vehicle engine is started if emissions exceed a threshold. Ideally, the threshold is set to a level that is not harmful to people and animals. Vibration sensor may include an acoustic sensor or other type of mechanical vibration sensor. When the engine is located in a garage, the noise from the engine will appear louder than if it were outside because the sound waves are reflected off the garage walls and ceiling. Processing electronics 604 may be configured to determine that vehicle engine is started if vibration levels exceed a threshold. Temperature sensor may be configured to assist processing electronics 604 in monitoring the temperature inside the garage. When the engine is started and running in the garage, the heat from the engine and the exhaust increase the garage temperature. Processing electronics 604 may be configured to determine that vehicle engine is started if temperature levels exceed a threshold. Temperature thresholds may be determined by establishing a baseline temperature as described above.

Field sensor 612 may include a magnetic field sensor, an inductive field sensor, or any other type of field sensor disposed in the garage. When an engine is started there is a change in the surrounding magnetic and inductive fields that can be sensed by magnetic and inductive sensors. Processing electronics 604 may be configured to determine that vehicle engine is started if the sensed field changes or the fields strengths exceed a threshold. Field sensor 612 may be configured to measure field strength, field direction, or other field characteristics. Field sensor 612 may be part of a sensor kit provided as an accessory or add-on to garage door opener 14, or garage door opener 14 may come equipped from the manufacturer. Field sensor 612 may be a preexisting component on garage door opener 14 or may be disposed in the garage an coupled to the garage door 14. One such component that could be integrated into garage door opener 14, or added by a user, is a compass or compass system. A compass system may sense change in the magnetic field when the engine is started and may be configured to provide data to processing electronics 604 for determining when the magnetic field increases above a threshold.

Processing electronics 604 may be configured to identify differences in the received data to determine whether the field levels (e.g., magnetic fields, inductive fields) indicate that the vehicle engine is started and that the vehicle is in the garage. Processing electronics 604 may be configured with predetermined thresholds related to the fields. The thresholds may be established by the manufacturer or during setup and configuration of the system.

Further, processing electronics 604 may be configured to identify differences in the received data to determine whether the environmental level (e.g., emissions, vibration or temperature) indicates that the vehicle engine is started, that the vehicle engine is started and the vehicle is in the garage, or that the vehicle engine is started, in the garage and the garage door is closed. With respect to temperature, the thresholds may be set from a varying baseline temperature. The varying baseline temperature may be used to account for different seasons, times of the day or other changes in weather patterns. Processing electronics 604 may use various means and methods to establish a baseline temperature from which thresholds may be determined. For example, processing electronics 604 may be configured to access the internet via a home wireless or wired network to obtain current outside temperature information. Location information (e.g., zip code) may be provided when the system is configured. Alternatively, processing electronics may be coupled to a temperature sensor located outside of the garage for detecting the current outside temperature.

Additional sensors may be used in conjunction with environment sensor 610 to assist processing electronics 604 in determining whether the vehicle 10 is started, whether vehicle 10 is in the garage and/or whether the garage door is closed.

Alternatively, processing electronics 604 may be configured to simply detect a harmful, or near harmful, condition rather than attempting to determine that the vehicle is started and in the garage with the garage door closed. If emission levels or temperature levels in the garage exceed a threshold, the garage door 18 may be actuated irrespective of whether the vehicle engine is started. For example, a combustion engine electrical power generator, or a vehicle without emergency garage door actuation capability, may be started in the same garage as vehicle 10. If processing electronics 604 sense emission or temperature levels above the thresholds, then processing electronics 604 may be configured to provide a command to the garage door opener 14 to open the garage door 18.

Referring to FIGS. 6 and 7B, in an exemplary embodiment, interface 602 is coupled to at least one sensor. In step 708, processing electronics 604 disposed in the garage or integrated into the garage door opener receives first data from a sensor (e.g., field sensor 612, environment sensor 610) coupled to interface 602, and in step 712, determines whether the vehicle engine is started based on the first data received from the sensor. If processing electronics 604 determines that the engine has not started then processing electronics 604 continues to receive and process data. In step 710, processing electronics 604 disposed in the garage, or integrated in to the garage door opener 14, receives second data from one or more sensors coupled to interface 602. In step 714, processing electronics 604 determines whether the vehicle 10 is in the garage and whether the garage door is closed based on at least the second data from the sensor. If processing electronics 604 determines that the vehicle 10 is not in the garage or that the garage door 18 is open then processing electronics continues to receive and process data. In step 716, processing electronics 604 provides a command to cause the garage door opener 14 to open the garage door 18 based on whether the vehicle 10 is started, whether the vehicle 10 is in the garage and whether the garage door 18 is closed. In step 718, the garage door opener 14 opens the garage door 18 in response to the command.

Various sensors and combinations of sensors may be used by processing electronics of garage door opener 14 to determine whether to provide a command to cause actuation of the garage door 18 in response to the data received from the sensors. As mentioned above, the sensors coupled to interface 602 may include the an engine is started. Referring to FIG. 6, garage door opener 14 may include environment sensor 610, field sensor 612, emission pattern sensor 614, radar sensor 616, sonar sensor 618, RF sensor 620, capacitive sensor 622, camera 624, photoelectric sensor 626, or pressure sensor 628, memory 630 or any other type of sensor capable of being disposed in the garage or integrated into garage door opener 14.

In an exemplary embodiment, environment sensor 610 may be coupled to interface 602 and configured to provide data with respect to an sensed environmental condition. As discussed above, environment sensor may include an emissions sensor, a vibration sensor and a temperature sensor. Emission sensor may be configured to provide emissions data to processing electronics 604 via interface 602 to assist in determining whether the vehicle engine is started. Vibration sensor may be configured to provide vibration data to processing electronics 604 via interface 602 to assist in determining whether the vehicle engine is started. Temperature sensor may be configured to provide temperature data to processing electronics 604 via interface 602 to assist in determining whether the vehicle engine is started.

Environment sensor 610, disposed in the garage may be coupled to interface 602 and configured to provide data to processing electronics 604 to assist in determining whether the vehicle 10 is in the garage while the engine is started. As discussed above, environment sensor may include an emissions sensor, a vibration sensor, and a temperature sensor. The emission sensor may be configured to sense at least one engine emission. Processing electronics 604 may be configured to determine that the vehicle is in the garage when the sensed emission level exceeds a threshold. The emission sensor may be configured to sense at least one engine emission to determine whether the garage door is closed while the engine is running in the garage. If the garage door is closed while the engine is running in the garage the emission levels will be higher than if the garage door were open. Processing electronics 604 may be configured to determine that the vehicle is started in the garage with the garage door closed when the sensed emission level exceeds a threshold. Ideally, the one or more thresholds are set to levels that are not harmful to people and animals.

The vibration sensor, as discussed above, may include an acoustic sensor or other type of mechanical vibration sensor. When the engine is started in the garage, the noise from the engine will be detectable by the vibration sensor disposed in the garage. Processing electronics 604 may be configured to determine that the vehicle is started when the sensed vibration level exceeds a threshold. Processing electronics 604 will be able to determine that the vehicle is located in the garage, which is where the vibration sensor is disposed, when the sensed vibration level exceeds a threshold. Further, the sensed vibrations may be greater when the garage door is closed, as opposed to open, while the engine is started in the garage. Processing electronics 604 may be configured distinguish between the vibration levels of a closed garage and an open garage. Processing electronics 604 may be configured to determine that the garage door is closed when the sensed vibration level exceeds a threshold. Processing electronics 604 may use various means and methods to establish a baseline temperature from which thresholds may be determined. For example, processing electronics 604 may be configured to access the internet via a home wireless or wired network to obtain current outside temperature information. Location information (e.g., zip code) may be provided when the system is configured. Alternatively, processing electronics may be coupled to a temperature sensor located outside of the garage for detecting the current outside temperature.

The temperature sensor may be configured to monitor the temperature of the garage. When the engine of vehicle 10 is started and running in the garage, the heat from the engine and exhaust increase the temperature of the garage. Processing electronics 604 may be configured to determine that the vehicle 10 is started when the sensed temperature level exceeds a threshold. Processing electronics 604 may be configured to determine that the vehicle is located in the garage, which is where the temperature sensor is disposed, when the sensed temperature level exceeds a threshold. When the engine of vehicle 10 is started and running in a garage and the garage door is closed, the heat from the engine and the exhaust trapped in the garage increase the temperature in the garage. The temperature sensor may be configured to provide data to processing electronics 304 via interface 302 to assist in determining whether the garage door is closed when the sensed temperature exceeds a threshold. The thresholds for determining whether the vehicle is started, whether the vehicle is in the garage and whether the garage door is closed may be different thresholds. As discussed above, processing electronics may utilizes various means and methods to determine a baseline temperature for setting thresholds. Processing electronics may obtain data from a variety of sources, including an internal clock or calendar system, a navigational system or device and a server 1146.

Field sensor 612 may be coupled to interface 602 and configured to provide data with respect to the field levels in the garage. Field sensor 612 may include a magnetic field sensor, inductive field sensor, or any other type of field sensor capable of being disposed in the garage. The effect of the presence of vehicle 10 in the garage on the fields in the garage may be sufficient to assist processing electronics 604 in determining whether vehicle 10 is in the garage. The magnetic and/or inductive field sensors may be placed anywhere in the garage, including the garage ceiling, walls or floor, the garage door opener 14 or the garage door 14. In addition to changing when the vehicle is present in the garage, the magnetic and inductive fields in the garage will change when vehicle 10 is started. The differences in the magnetic and inductive fields when the vehicle is started and off may be significant enough to allow processing electronics 604 to determine whether the engine in running. In either case (started or off), field sensor 612 may be able to detect that vehicle 10 or engine is in the garage.

Processing electronics 604 may be configured to determine that the vehicle 10 is started when the sensed field level exceeds a threshold. If field sensor 612 is not sensitive enough to detect the presence of vehicle 10 when turned off, the processing electronics 604 may be configured to recognize patterns of change in the magnetic and inductive fields when the engine is started and turned off. The change in magnetic and inductive fields may be noticeably different at start up of the engine as compared to turn off. Processing electronics 604 may see a sharp upward spike in field strength during ignition of the engine indicating that the engine is being started and a steep drop off in field strength with no upward spike when the engine is turned off. If processing electronics 604 detects that the engine has been turned off, then processing electronics 604 may assume that the vehicle 10 is located in the garage. If processing electronics 604 detects that there has been a start up of the engine and then a steady reduction in field strength, then processing electronics 604 may assume that vehicle 10 was started in the garage and then left the garage. Thus, processing electronics 604 configured to receive data from field sensor 612 via interface 602 may be able to determine whether vehicle 10 is in the garage based on the detected patterns of change in the garage field.

Emission pattern sensor 614 may be coupled to interface 602 and configured to provide data with respect to the patterns of emission levels in the garage. Emission pattern sensor 614 may be disposed anywhere in the garage or built into garage door opener 14. Emission patterns vary for starting up and shutting down an engine. If the detected emission pattern indicates that the vehicle 10 has started up and then the emissions stopped, the processing electronics 604 may assume that the vehicle 10 started and left the garage. If the detected emission pattern indicates that the vehicle 10 shut down and no more emissions have been detected since, the processing electronics 604 may assume that the vehicle 10 is still located in the garage.

Radar sensor 616 may be coupled to interface 602 and configured to provide data with respect to the surroundings inside the garage. Radar sensor 616 may be disposed anywhere in the garage or built into garage door opener 14. Processing electronics 604 may be configured to use data received from radar sensor 616 via interface 602 to determine whether vehicle 10 is located in the garage. In particular, vehicle 10 may be easy to detect in the garage because of its size and reflective material. Indeed, processing electronics 604 may be configured to recognize a particular vehicle based on its size. Furthermore, radar sensor 616 may be directed toward locations in the garage where vehicle 10 will likely be parked when vehicle 10 is in the garage. The vehicle owner may also place reflectors or other types of objects on the vehicle 10 to allow the processing electronics 604 to uniquely identify the vehicle 10, or to simply improve detection. Alternatively, the user may place objects or reflectors in such a way that the object or reflector will at least be partially blocked from detection by processing electronics 604 when the vehicle 10 is in the garage. For example, radar sensor 616 may be mounted on the ceiling and directed toward the garage floor. The garage floor may be include a marker below the radar sensor 616 and in the location where the vehicle 10 parks in the garage. When vehicle 10 is in the garage, radar sensor 616 will not be able to detect the reflector and processing electronics 604 may be able to determine that vehicle 10 is in the garage. When vehicle 10 is not in the garage, radar sensor 616 will detect the reflector and processing electronics 604 may be able to determine that vehicle 10 is not in the garage.

The radar signal used for detecting the vehicle 10 may be adversely affected by the electromagnetic radiation caused by a started engine. However, the disturbance caused by the engine may be used by processing electronics 604 to identify the presence of the vehicle 10 in the garage. The disturbance may also be used to determine that the vehicle 10 is started in the garage. Processing electronics 604 may be coupled to a memory to store disturbance patterns caused by vehicle 10 and other engines that may be used in the garage, such as a combustion engine electrical power generator or other vehicles, in order to determine which engine is started.

Processing electronics 604 may be configured to use data received from radar sensor 616 via interface 602 to determine whether the garage door 18 is closed. Radar sensor 616 may be configured to detect distances to objects. Data from radar sensor 616 may be used by processing electronics 604 to determine whether the garage door is closed by transmitting a radar signal in the direction of the garage door opening. Radar sensor 616 may be disposed on the garage walls, ceiling, or floor, the garage door opener, or the garage door. Furthermore, various types of reflectors, objects or other items may be disposed in the garage to improve detection of a closed garage door. For example, radar sensor 616 may be affixed to a garage wall and directed toward the garage door opening and configured to transmit a radar signal in the direction of the garage opening. If the garage door 18 is closed, processing electronics 604 will be able to determine the distance from radar sensor 616 to the closed garage door 18. If the garage door 18 is open, the transmitted radar signal will pass through the garage door opening and reflect off objects outside the garage. The objects detected outside of the garage will appear relatively far away from radar sensor 616 and processing electronics 604 will be able to determine that the garage door 18 is open. A reflector may be affixed to the garage door 18 to enhance detection of the garage door 18 position.

Sonar sensor 618 may be coupled to interface 602 and configured to provide data with respect to the surroundings inside the garage. Sonar sensor 618 may be disposed anywhere in the garage or built into garage door opener 14. Like radar, sonar sensor 618 may be used to detect distances to objects. Processing electronics 604 may be configured to use data received from sonar sensor 618 via interface 602 to determine whether vehicle 10 is located in the garage. Sonar sensor 618 may be used to assist processing electronics 604 in determining whether the vehicle 10 is in the garage by detecting the location of large objects in the garage. Processing electronics 604 may be coupled to a memory configured to store a data relating to the objects in the garage (e.g., a "sonar map" of the garage) and compare subsequent measurements with the stored data to determine whether the vehicle 10 is in the garage. In particular, vehicle 10 may be easy to detect in the garage because of its size and reflective material. Indeed, processing electronics 604 may be configured to recognize a particular vehicle based on its size. Furthermore, sonar sensor 618 may be directed toward locations in the garage where vehicle 10 will likely be parked when vehicle 10 is in the garage. The vehicle owner may also place reflectors or other types of objects on the vehicle 10 to allow the processing electronics 604 to uniquely identify the vehicle 10, or to simply improve detection. Alternatively, the user may place objects or reflectors in such a way that the object or reflector will at least be partially blocked from detection by processing electronics 604 when the vehicle 10 is in the garage. The sonar signal used for detecting an engine may be adversely affected by the acoustic vibrations from a started engine. However, the disturbance caused by the started engine may be used by processing electronics 604 to identify the presence of the vehicle 10 in the garage. The disturbance may also be used by processing electronics 604 to determine that the vehicle 10 is started in the garage. Processing electronics 604 may be coupled to a memory to store disturbance patterns caused by vehicle 10 and other engines that may be used in the garage, such as a combustion engine electrical power generator or other vehicles, in order to determine which engine is started.

Processing electronics 604 may be configured to use data received from sonar sensor 618 via interface 602 to determine whether the garage door 18 is closed. Sonar sensor 618 may be configured to detect distances to objects. Data from sonar sensor 618 may be used by processing electronics 604 to determine whether the garage door is closed by transmitting a sonar signal in the direction of the garage door opening. Sonar sensor 618 may be used by processing electronics 604 to determine whether a garage door 18 is open in much the same way as radar sensor 616. Sonar sensor 618 may be disposed on the garage walls, ceiling, or floor, the garage door opener, or the garage door. Furthermore, various types of reflectors, objects or other items may be disposed in the garage to improve detection of a closed garage door. For example, sonar sensor 618 may be affixed to a garage wall and directed toward the garage door opening (or the garage door in the closed position) and configured to transmit a sonar signal in the direction of the garage opening. If the garage door is closed, the processing electronics 604 will be able to determine the distance from sonar sensor 618 to the closed garage door 18. If the garage door is open, the sonar signal will pass through the garage door opening and reflect off objects outside the garage. The objects detected outside of the garage will appear relatively far away and the processing electronics 604 will be able to determine that the garage door 18 is open. A reflector may be affixed to the garage door to enhance detection of the garage door position.

RF sensor 620 may be coupled to interface 602 and configured to provide data with respect to the surroundings of vehicle 10. RF sensor 620 may be disposed any where in the garage or integrated into garage door opener 18. Processing electronics 604 may be configured to use data received from RF sensor 620 via interface 302 to determine whether vehicle 10 is in the garage. Radio Frequency (RF) sensor 620 may be used by processing electronics 604 to determine distances to objects by measuring the reflections resulting from a transmitted RF signal. Processing electronics 604 may be configured to use RF sensor 620 to determine distance to objects by measuring the time from transmission of the RF signal to the return of the RF reflection. Processing electronics may be configured to used RF Sensor 620 to determine distance by measuring the strength of the reflected signal and comparing the reflected signal strength to the strength of the transmitted signal. Processing electronics 604 may also be configured to use both time and signal strength to determine distance. RF sensor 620 may be disposed anywhere in the garage, including the garage ceiling, walls or floor, the garage door opener and the garage door. RF reflectors or other kinds of RF ID tags may be placed on the vehicle 10 to assist in uniquely identifying the vehicle 10 or to simply assist in determining that the vehicle 10 is in the garage. The reflectors or tags may also serve to uniquely identify the garage or even the garage stall in which vehicle 10 is parked. An RF sensor 620 may be disposed in each garage stall to identify which stall is occupied. RF reflectors 620 may be disposed in the garage such that when vehicle 10 is in the garage, the RF reflector 620 is partially obstructed by vehicle 10 to provide an indication to processing electronic 604 that vehicle 10 is in the garage. When the RF reflector is visible, the processing electronics may determine that vehicle 10 is not in the garage.

Processing electronics 604 may be configured to use data received from RF sensor 620 via interface 602 to determine whether the garage door 18 is closed. RF sensor 620 may be disposed anywhere in the garage, including the garage ceiling, walls or floor, the garage door opener 14 and the garage door 18. For example, RF sensor 620 may be affixed to the garage wall, directed toward a garage door opening and configured to transmit an RF signal. If the garage door is closed, the processing electronics 604 will be able to determine the distance to the closed garage door. If the garage door is open, the signal will pass through the garage door opening and reflect off objects outside the garage. The objects detected outside of the garage will appear relatively far away and processing electronics 604 will be able to determine that the garage door is open. RF reflectors, or other kinds of RF ID tags, may be placed any where in the garage, including the garage door, walls and ceiling, to enhance detection of the position of the garage door 18. For example, RF sensor 620 may be affixed to the garage ceiling above the garage door when in open position, directed toward the garage floor, and configured to transmit an RF signal. A reflector may be disposed on the outside of the garage door 18 to enhance detection of the garage door in the open position. If the garage door is closed processing electronics 604 will not detect the reflector and the distance determined will to the top of the vehicle 10 or the garage floor. If the garage door is open, processing electronics 604 may be able to detect the reflector and the distance determined by processing electronics 604 will be to the garage door in open position. The distance to the garage door in open position will be less than the distance to the top of the vehicle or garage floor. Thus, the processing electronics 604 will be able to determine the position of the garage door 18. The reflectors or tags may also serve to uniquely identify a particular garage door if there are multiple garage doors. If a separate RF sensor 620 is used for each garage door in a multi door garage, then each garage door may be uniquely identified by processing electronics 604 using its corresponding RF sensor.

Capacitive sensor 622 may be coupled to interface 602 and configured to provide data with respect to the presence of vehicle 10 in the garage. Sonar sensor 618 may be disposed anywhere in the garage or built into garage door opener 14. Processing electronics 604 may be configured to use data received from capacitive sensor 622 via interface 602 to determine whether vehicle 10 is located in the garage. Capacitance can be measured between two conductive surfaces that are within proximity to one another. Capacitive sensor 124 may be configured to provide capacitance data to processing electronic 604 to measure the capacitance between an electrode (e.g., conductive plate) disposed in the garage and vehicle 10. As vehicle 10 enters the garage and approaches the electrode, the capacitance measured between vehicle 10 and the electrode increases. Processing electronics 604 may be configured to determine that the vehicle 10 is in the garage when the measured capacitance exceeds a predetermined threshold. The electrode in the garage may be disposed on the garage wall facing vehicle 10 as it enters the garage, or it may be positioned above the location where vehicle 10 parks in the garage. Alternatively, the electrode may be integrated into the garage floor or it may be a mat that the vehicle parks on top of in the garage. Alternatively, the electrode may be integrated into the garage door so that the electrode is above vehicle 10 when vehicle 10 is entering the garage and behind vehicle 10 when the garage door closes. Different capacitance thresholds could be used for up and down positions to further determine whether the garage door is open or closed when vehicle 10 is in the garage.

Camera 624 may be coupled to interface 602 and configured to provide data with respect to the surroundings inside the garage. Camera 624 may be mounted on, or built into, the garage door opener 14, the garage door, the garage ceiling, or any other portion of the garage. Camera 624 may provide data to processing electronics 604 via interface 602 to assist in determining whether the vehicle 10 is located in the garage. Processing electronics 604 may be configured to process the data received from camera 624 using various pattern recognition and image processing techniques. Using various image processing techniques, processing electronics 604 may be able to recognize the vehicle due to its large size. The recognizable aspects of the vehicle may include color, shape, shading, brightness, darkness, contrasting colors, size, etc. The user may enhance the ability of processing electronics 604 to uniquely recognize that the vehicle 10 is in the garage by including stickers, markers, objects or other items on vehicle 10. Alternatively, the user may enhance the ability of processing electronics 604 to uniquely recognize that the vehicle 10 is in the garage by including stickers, markers, objects or other items in the garage, such that when the vehicle 10 is in the garage the marker is at least partially blocked from view by the vehicle 10. For example, camera 624 may be mounted on the ceiling and directed toward the garage floor. The garage floor may be include a marker below the camera 624 and in the location where the vehicle 10 parks in the garage. When vehicle 10 is in the garage, camera 624 will not be able to see the marker and processing electronics 604 may be able to determine that vehicle 10 is in the garage. When vehicle 10 is not in the garage, camera 624 will see the marker and processing electronics 604 may be able to determine that vehicle 10 is not in the garage.

Camera 624 may provide data to processing electronics 604 via interface 602 to assist in determining whether the garage door is closed. Camera 624 may be configured to process the received data using various pattern recognition and image processing techniques. Using various image processing techniques, processing electronics 604 may be able to recognize certain aspects of the garage that would indicate that the garage door is closed. For example, if the image is dark but it is day time, processing electronics 604 may determine that the reason the garage is dark during the day time is because the garage is closed. Other recognizable aspects of the garage may include color, shape, shading, brightness, darkness, contrasting colors, sizes of shapes, etc. Camera 624 may be disposed in various locations throughout the garage and direct to the garage door in either the closed or open position. For example, camera 624 may be affixed to the garage wall and directed toward the garage door opening (e.g., garage door in the closed position). Processing electronics 604 may be configured to detect a difference between an open and closed garage door 18. The user may enhance the ability of processing electronics 604 to uniquely recognize that the garage door is closed by including stickers, markers, objects or other items. The garage door may have a sticker recognizable by processing electronics 604 on the inside of the garage door. If the door is closed, the sticker will be detected, and if the garage door is open, the sticker will not be detected.

Photoelectric sensor 626 may be coupled to interface 602 and configured to provide data with respect to the surroundings of the inside of the garage. Photoelectric sensor 626 may be disposed anywhere in the garage or built into garage door opener 14. Photoelectric sensors 626 may include sensors that use Infrared (IR), visible red, laser, UV or sensors using any other type of light. Photoelectric sensor 626 may be used to determine whether the vehicle 10 is in the garage by detecting distances and/or sizes of objects in the garage. Vehicle 10 is large object compared to other objects in the garage and can be identified either by location within the garage, or size. Processing electronics 604 may be coupled to a memory configured to store location and size data for the vehicle 10 in the garage and to compare subsequent measured data to determine whether vehicle 10 is in the garage.

The user may also use stickers, paint, reflectors, or other items to be used in conjunction with the various types of photoelectric sensors to assist processing electronics 604 in determining a unique identity of the engine or its presence in the garage. For example, the user could put special UV paint or stickers on the vehicle 10 to assist processing electronics 604 in detecting the reflections of UV light and determining that the vehicle 10 is in the garage. Other types of light signals and corresponding items (e.g., stickers, paint, reflectors) could be used in various configurations to determine that the vehicle 10 is located in the garage. Photoelectric sensor 626 may be positioned above the location in the garage where vehicle 10 is parked (e.g., in or on the garage door opener) and configured to provide data to processing electronics 604 for determining when vehicle 10 is parked below the sensor. When vehicle 10 is not present, the distance to the garage floor will be detected. The garage floor may be covered with stickers, paint, reflectors, or other items to be used in conjunction with the various types of photoelectric sensors to enhance the determination by processing electronics 604 of the distance from the photoelectric sensor 626 to the floor. When vehicle 10 is in the garage under the photoelectric sensor 626, the determined distance from the sensor to vehicle 10 will be noticeably shorter than the distance to the garage floor.

Further, many garage doors include a visible red light sensor at the bottom of the opening to assist in detecting whether the opening of the garage door is obstructed by an object or person. The visible red sensor could be configured to have two parallel sensors, one closer to the garage opening and one further away from the opening to assist processing electronics 604 in determining whether vehicle 10 is entering or exiting the garage. When vehicle 10 is entering the garage, the sensor nearest the garage opening will be blocked first by vehicle 10 and the sensor furthest from the opening will be blocked second. When vehicle 10 is leaving the garage the sensor furthest from the garage opening will be blocked first and the sensor closest to the garage opening will be blocked second. In this way, the direction of vehicle 10 can be determined by processing electronics 604. In order to avoid an improper determination that vehicle 10 has entered or left the garage, processing electronics 604 may be configured to use photoelectric sensor 626 to determine the time it takes for the object to pass through the detector and to compare that time to a threshold. The time it takes for a person or a bicycle to pass through the detector will typically be much less than the time it takes for vehicle 10 to pass through the sensor. Thus, if the time it takes for the object to pass exceeds a threshold, then it may be assumed that vehicle 10 passed through the detector.

Processing electronics 604 may be configured to use data received from photoelectric sensor 626 via interface 602 to determine whether the garage door is closed. Photoelectric sensors 626 may include sensors that use Infrared (IR), visible red, laser, UV or sensors using any other type of light. Photoelectric sensor 626 may be configured in a variety of ways to assist processing electronics 604 in determining whether garage door is closed. Photoelectric sensor 626 may be disposed on the garage walls, ceiling, or floor, the garage door opener, or the garage door. For example, photoelectric sensor 626 may be used to assist in determining whether the garage door is closed by transmitting a signal in the direction of the garage door opening. If the garage door is closed, processing electronics 604 will receive data indicating a distance from vehicle 10 to the closed garage door 18. If the distance determined is below a threshold, processing electronics 604 may determine that the garage door 18 is closed. If the garage door is open, the signal will pass through the garage door opening and reflect off objects outside the garage. The objects detected outside of the garage will appear relatively far away (e.g., above the threshold) and processing electronics 604 will be able to determine that the door is open. Furthermore, various types of reflectors, objects or other items may be disposed in the garage to improve detection of a closed garage door.

Photoelectric sensor 626 may also be affixed to the ceiling above the garage door when the garage door 18 is in an open position, the open position of the garage door obstructing the view of photoelectric sensor 626. In the open position, photoelectric sensor 626 provides data to processing electronics 604 for determining the distance to the open garage door. When the garage door is closed, photoelectric sensor 626 provides data to processing electronics 604 for determining a different distance, such as the distance to the top of vehicle 10 or the distance to the floor. In either case, the distance will be different from the distance to the garage door 18 while in open position. Processing electronics 604 may be coupled to a memory configured to store measurement data related to a closed garage door. The store measurement data may be used by processing electronics 604 to compare the data received from photoelectric sensor 626 with the stored data and to determine whether the garage door is open or closed. The user may also use stickers, paint, reflectors, or other items in conjunction with the various types of photoelectric sensors to assist processing electronics 604 in determining whether the garage door is closed. Furthermore, stickers, paint, reflectors, or other items in conjunction with the various types of photoelectric sensors may also be used to determine a unique identity of the particular garage door. For example, the user could put special UV paint or stickers on the inside of the garage door to detect UV light reflections to assist processing electronics 604 in determining that the garage door 18 is in either a closed or an open position. Other types of light signals and corresponding items (e.g., stickers, paint, reflectors) could be used in various configurations to assist processing electronics 604 in determining whether the garage door 18 is closed.

Pressure sensor 628 may be coupled to interface 602 and configured to provide data to processing electronics to assist in determining whether vehicle 10 is in the garage. Pressure sensor 628 may take a variety of forms, including a floor mat, upon which one or more tires of vehicle 10 rests when parked in the garage. The mat may be configured to sense the weight of vehicle 10 and provide data to processing electronics 604 for determine that the vehicle 10 is in the garage. Pressure sensor 628 may also comprise one or more compressible tubes or strips that run along the floor of the garage parallel to the garage opening. Ideally, at least two tubes or stripes are used to assist processing electronics 604 in more precisely determining whether vehicle 10 is entering or exiting the garage. For example, two tubes may be place parallel to the opening of the garage. The tubes may be placed a few inches apart. When vehicle 10 is entering the garage, the tube nearest the garage opening will be compressed first and the tube furthest from the opening will be compressed second by the front wheel of vehicle 10. Presented with this data, processing electronics 604 may be able to determine that vehicle 10 is in the garage. When vehicle 10 is leaving the garage, the tube furthest from the garage opening will be compressed first and the tube closest to the garage opening will be compressed second. Presented with this data, processing electronics 604 may be able to determine that vehicle 10 is not in the garage. Using two or more tubes or strips allows processing electronics to determine the direction vehicle 10 is traveling.

Memory 630 may be coupled to interface 602 and configured to store and provide data with respect to the state of the garage door 18. Memory 630 may be configured to interact the processing electronics 604 and to store the state of the garage door, the two states being closed and open states. Processing electronics may be coupled to a state machine or other control device that is aware of the state of the garage door, and may be configured to store that current state in memory 630. Alternatively, processing electronics may be configured to track and store the current state of the garage door 18. Memory 630 may be used in conjunction with any other sensor to track and assist processing electronics 603 in determining the present state of the garage door 18.

While the different types of sensors have been discussed individually, it is to be understood that the sensors may be used in various configurations and combinations to assist processing electronics in determining whether vehicle 10 is in the garage and whether the garage door is closed. Further processing electronics 604 may be implemented in one or more processing circuits, including one or more integrated circuits, general purpose processors, application specific integrated circuits, field programmable gate arrays, etc. The processing electronics 604 may also be implemented using computer code stored in a memory and executable by the processing electronics.

Transmitter 606 may be coupled to processing electronics 604 and configured to transmit data to remote receivers, such as remote garage door transceivers disclosed in the vehicle 10. Receiver 608 may be coupled to processing electronics 604 and configured to receive a control signal from a remote transmitter to cause the garage door opener 14 to actuate the garage door 18. Garage door opener 14 may be configured to receive fixed or variable code control signals. Further, transmitter 606 and receiver 608 may be configured to communicate with remote devices using any RF or wireless standard, such as WiFi (e.g., including IEEE 802.11), WiMax, etc.

A determination to actuate the garage door may be made by the processing electronics 604 configured to receive data from at least one sensor. The number of sensors needed to make a proper determination to actuate the garage door will depend upon which types of sensors or combinations of sensors are used for detecting the various conditions, including: whether vehicle 10 is started, whether vehicle 10 is in the garage and whether the garage door is closed. Furthermore, the number of sensors needed will depend on how sensitive the various types of sensors are. For example, processing electronics 604 may be configured to provide a command to open the garage door in response to an environment sensor detecting emission levels above a threshold. If emission levels are above a threshold, processing electronics 604 may assume that vehicle 10 is started, that vehicle 10 is located in the garage, and that the garage door is closed. Thus, emission sensor may be the only sensor required by processing electronics 604 to determine whether to provide a command to actuate the garage door 18. Other sensors may be used to ensure that the garage door 18 is properly actuated, such as an emission pattern sensor 614 or field sensor 612 to determine that the vehicle is in the garage, or a proximity sensor (e.g., radar sensor 616, sonar sensor 618, photoelectric sensor 626 or RF sensor 620) configured to provide data to processing electronics 604 for determining the position of garage door 18. As discussed above, field sensor 612 may be configured to determine that vehicle 10 is started and that vehicle 10 is in the garage. However, additional sensors may be required by processing electronics 604 to determine that the position of the garage door 18, such as a proximity sensors or a garage door status signal stored in memory. Various combinations and configurations of sensors could be used by processing electronics 604 to determine whether a command to actuate the garage door 18 should be generated.

Emergency Actuation Determined by the Vehicle and the Garage Door Opener

Figure 8:
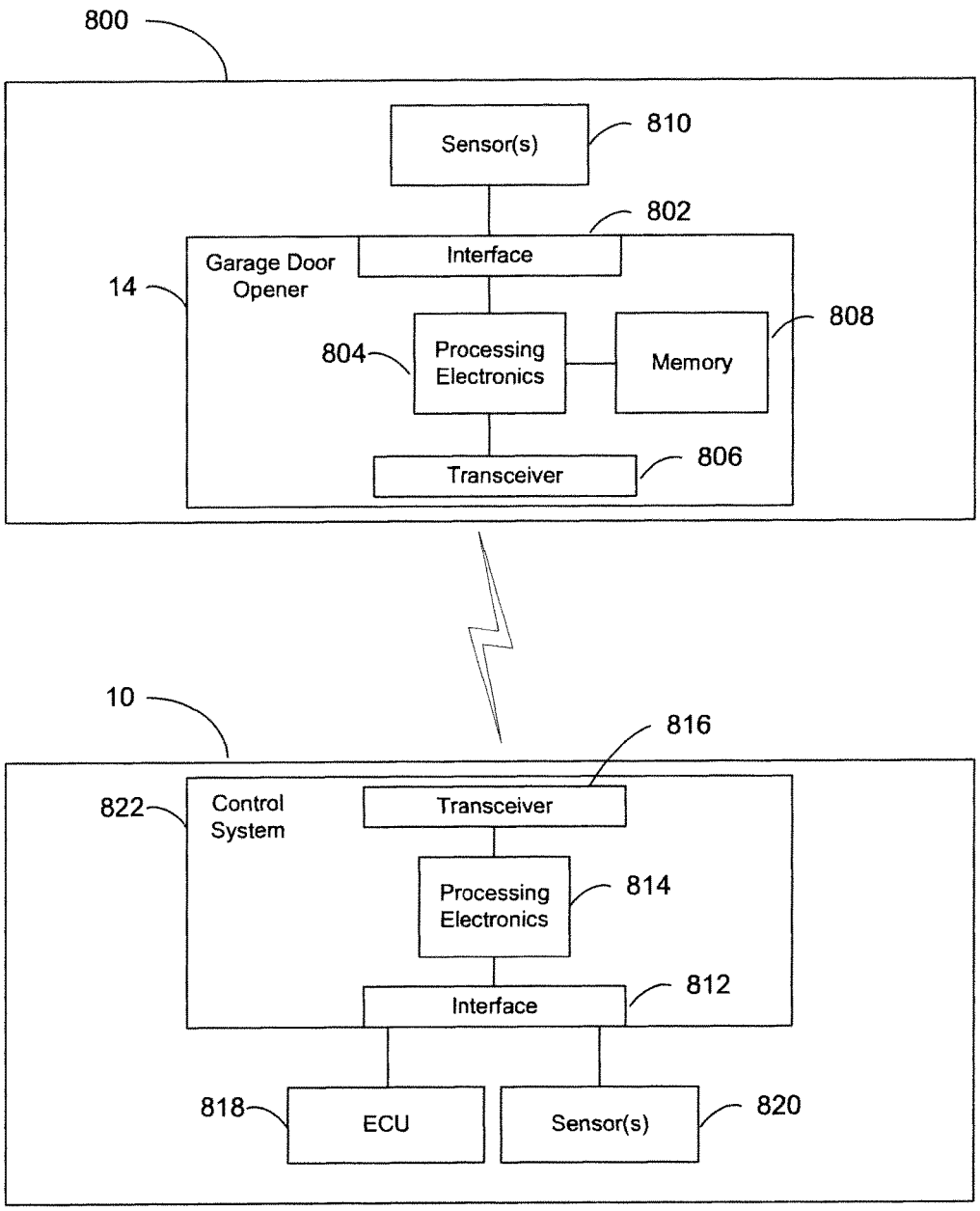
FIG. 8 is a schematic block diagram of an control system in a vehicle and a garage door opener configured to determine conditions for actuating a garage door in accordance with an embodiment.

Referring to FIG. 8, garage door opener 14 and control system 822 of vehicle 10 may be configured to both participate in determining whether to actuate the garage door 18. In an exemplary embodiment, control system 822 is mounted to a vehicle 10 for opening the garage door 18 using a garage door opener 14 remote from the vehicle 10. The garage door opener 14 is including a receiver circuit (e.g., receiver portion of transceiver 806). The control system 822 includes an interface for receiving first data from at least one sensor that indicates whether the vehicle engine has started. The interface is also configured to receive a second data from at least one sensor that indicates whether the vehicle 10 is in the garage. Control system 822 further comprises a transceiver 816 configured to receive third data from the garage door opener 14 indicating whether the garage door 18 is closed. Control system 822 also includes processing electronics 814 configured to receive the first, second and third data from the interface and transceiver, and to use the received first, second and third data to determine: whether the vehicle engine is started, whether the vehicle 10 is in the garage and whether the garage door 18 is closed. Processing electronics 814 is further configured to send a command to the transceiver to generate a control signal for transmission to the garage door opener 14 based on the determination of whether the vehicle engine is started, whether the vehicle 10 is in the garage and whether the garage door 18 is closed. The transceiver 816 is configured to transmit the control signal in response to the command. The control signal is formatted for recognition by the wireless receiver of the garage door opener and to cause the garage door opener 14 to open the garage door 18.

The garage door opener 14 in garage 800 comprises an interface 802 for coupling to one or more sensors and configured to receive data from the one or more sensors. Garage door opener 14 also comprises a transceiver 806 with a receiver circuit and transmitter circuit for receiving and transmitting wireless signals. Alternatively, garage door opener may only comprise a receiver circuit for receiving control signals from remote transmitters. Garage door opener further comprises processing electronics 804, which may be configured to perform one or more functions. Transceiver 806 may receive a control signal from control system 822 and be configured to provide control data based on the control signal to processing electronics 804. Processing electronics 804 may be configured to receive and process the control data to determine whether to issue a command to actuate the garage door based on the control data. Processing electronics 804 may also be coupled to interface 802 and configured to receive data from sensors 810 and to use the data to determine one or more of the following: whether the vehicle 10 is started, whether the vehicle 10 is in the garage, and whether the garage door is closed. The results of the one or more determinations may be communicated to control system 822 so that processing electronics 814 of vehicle 10 may make the ultimate determination of whether the garage door should be actuated. Alternatively, processing electronics 814 may also be coupled to interface 812 and configured to receive data from sensors 818 and/or 820 and to use the data to determine one or more of the following: whether the vehicle 10 is started, whether the vehicle 10 is in the garage, and whether the garage door is closed. The results of the one or more determinations may be communicated to garage door opener 14 so that processing electronics 804 of garage door opener 14 may make the ultimate determination of whether the garage door should be actuated. Processing electronics 804 of garage door opener 14 may also be coupled to memory 808, which may be configured to store data regarding the current state of the garage door (e.g., open or closed) or any other data related to sensors 810 (e.g., radar or sonar map of the garage, RF signal strengths or transmission times, thresholds).

Alternatively, garage door opener 14 may be configured to only include processing electronics 804 coupled to memory 808 and transceiver 806 (e.g., no interface 802 or sensors 810). Memory 808 may be configured to track the current state of the garage door 18 and processing electronics 804 may be configured to provide control system with data regarding the current state of the garage door via transceiver 806 to assist processing electronics 814 of control system 822 in determining whether the garage door should be actuated. In this way the garage door opener 14 assists in determining whether the garage door 18 is closed. The transceiver circuit need not be integrated into the garage door opener 14 but may be a remote device that connects to the garage door opener 14 and configured to communicate data to control system 822 of vehicle 10.

Garage door opener 14 may also be configured to have at least one sensor and to provide the sensor data to control system 822 of vehicle 10 for determining whether to actuate the garage door 18. Alternatively, control system 822 may be configured to have at least one sensor and to provide sensor data to processing electronics 804 of garage door opener 14. Referring to FIG. 3, vehicle 10 may include one or more of the following sensors: engine control unit (ECU) 310, a field sensor 312, an environment sensor 314 (e.g., emission sensor, vibration sensor, temperature sensor), an RF sensor 316, a radar sensor 318, a sonar sensor 320, a camera 322, a photoelectric sensor 324, a global positioning system 326, or any other type of sensor capable of being disposed in or on vehicle 10. Referring to FIG. 6, garage door opener 14 may be coupled to one or more of the following sensors: an environment sensor 610, a field sensor 612, an emission pattern sensor 614, a radar sensor 616, a sonar sensor 618, an RF sensor 620, a capacitive sensor 622, a camera 624, a photoelectric sensor 626, a pressure sensor 628, a memory 630, or any other type of sensor capable of being disposed in a garage or garage door opener 14. As discussed above, sensors data to processing electronics to assist in determining whether an the vehicle 10 is started, whether vehicle 10 is in the garage, and whether the garage door 18 is closed. Certain of these determinations may be more easily detected by sensors and processing electronics in garage door opener 14 or in vehicle 10. For example, sensors and processing electronics 814 of vehicle 10 may more readily be able to detect that the vehicle 10 is started, while sensors and processing electronics 804 of garage door opener 14 may be able to more easily detect that the garage door 18 is closed. However, processing electronics or vehicle 10 or garage door opener 14 may not be capable of being configured to relay, or appropriately process the data, therefore, other configurations are possible where sensors and processing electronics 814 of vehicle 10 detect a garage door position and the sensors and processing electronics 804 of garage door opener 14 determines whether the vehicle 10 is started.

Figure 9:
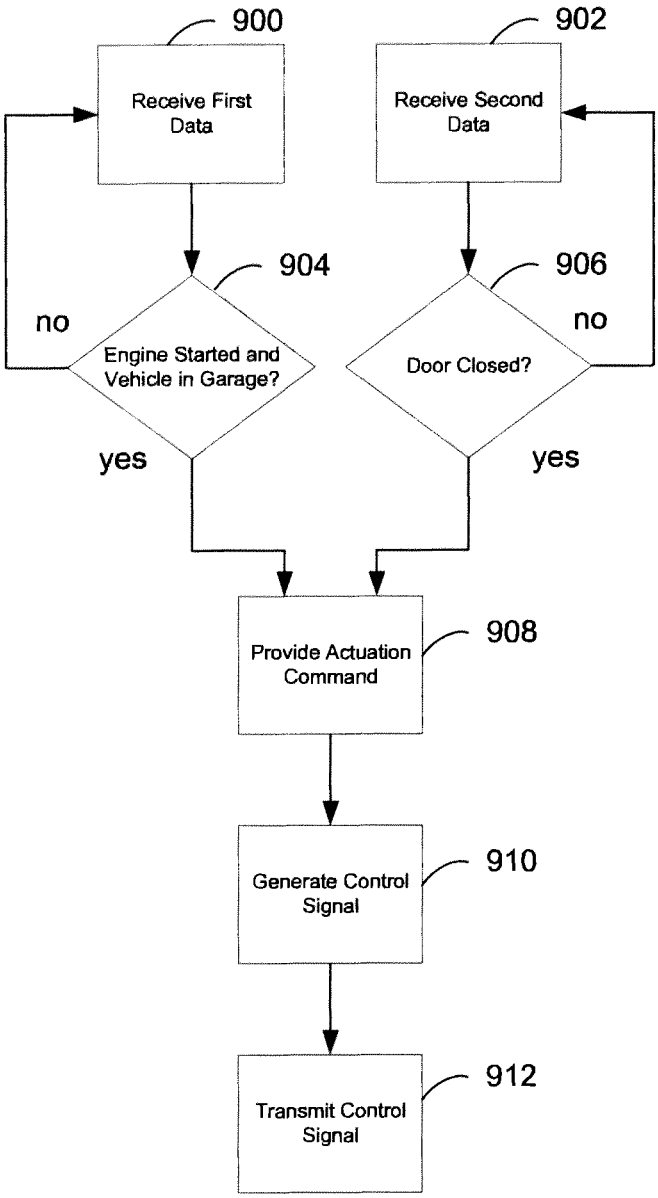
FIG. 9 is a flow diagram illustrating the steps taken by control system in a vehicle and a garage door opener to cause the garage door opener to actuate the garage door in response to sensed conditions in accordance with an embodiment.

Referring to FIGS. 8 and 9, in an exemplary embodiment, interface 812 of control system 822 is coupled to at least one sensor. In step 900, processing electronics 814 receives first data indicating whether the vehicle is started and whether the vehicle is in the garage and in step 904, processing electronics determines whether the vehicle is started and whether the vehicle 10 is in the garage. If processing electronics 814 determines that the vehicle 10 is not started or the vehicle 10 is not in the garage then processing electronics 814 continues to receive and process data. Processing electronics 814 receives second data from the garage door opener 14 indicating whether the garage door 18 is closed and determines whether the garage door is closed based on the second data received. If processing electronics 814 determines that the garage door is not closed, then processing electronics 814 continues to receive and process data. If processing electronics 814 determines that the vehicle 10 is started, vehicle 10 is in the garage and that the garage door is closed, then in step 908, processing electronics 814 is configured to provide an actuation command to transceiver 816 to generate a control signal formatted for recognition by a wireless receiver of the garage door opener 14 and to cause the garage door opener 14 to open the garage door 18 based on the determination of whether the vehicle engine is started, whether the vehicle is in the garage and whether the door is closed. In step 910, the transceiver 816 generates the control signal in response to the actuation command. In step 912, the transceiver 816 transmits the control signal to the wireless receiver of the garage door opener 14 in response to the command in order to cause the garage 18 door to actuate.

Various sensors may be utilized by processing electronics in vehicle 10 or garage door opener 14 in determining whether to actuate the garage door, including an environment sensor (e.g., emission sensor, temperature sensor, or vibration sensor), a field sensor (e.g., inductive, magnetic), an engine control unit (ECU), or engine temperature sensor. The advantage to using an environment sensor in either garage door opener 14, vehicle 10, or both, is that the environment sensor may be used to make the other determinations as well. For example, if the emissions are above a certain level, it may be assumed that vehicle 10 is started, otherwise there would be no emissions. Further, if the emissions sensor is in the garage, and emissions are detected, it may be assumed that vehicle 10 is located in the garage, otherwise there would be no emissions. Processing electronics may determine that the garage door is closed as a result of high sensed emission levels. The same may be true for temperature and vibration sensing. High temperature and vibration levels may indicate that vehicle 110 is started, in a garage and that the garage door is closed.

Other sensors may be more limited in the determinations that may be made from the sensor data. For example, a field sensor may be used to assist processing electronics in determining that vehicle 10 is started and that vehicle 10 is located in the garage. For example, if the field sensor is located in the garage, processing electronics may be configured to distinguish a started vehicle from an off vehicle due to higher fields radiated from the started vehicle. Furthermore, the detection of the fields by the field sensor in the garage would also indicate that vehicle 10 is in the garage when vehicle 10 started and off. Field strength dissipates rapidly and would likely be undetectable over long ranges, therefore, the detection of the fields requires the radiating body to be in close proximity to the sensor. A measured field above a threshold level may indicate that vehicle 10 is in the garage and may further indicate that vehicle 10 is started. ECU may provide data to indicating a started engine and an engine temperature, as well as other characteristics of the engine that would indicate that the engine is started. Other vehicle systems or sensors capable of providing data for assisting processing electronics in determining whether a vehicle engine is started may be utilized. The data indicating a started engine may be utilized by the processing electronics coupled to the interface that receives the data or the data may be transmitted to the processing electronics of the other system (e.g., garage door opener 14 or control system 822).

Sonar, radar and RF sensors may be disposed in the garage (e.g., walls, ceiling, door or floor) and directed toward a location in the garage where vehicle 10 is likely to park. Sonar, radar and RF sensors may be configured to assist processing electronics 804 in determining distances to objects and may be used to determine the distance to a vehicle in, or entering, the garage. As vehicle 10 enters the garage and moves closer to the RF, radar or sonar sensors, the measured distance decreases. If the measured distance drops below a threshold, a determination that vehicle 10 is in the garage may be made. Similarly, sonar, radar and RF sensors may be disposed in vehicle 10 and may assist processing electronics 814 in determining distances from vehicle 10 to objects. Furthermore, when disposed in vehicle 10, these sensors may be used by processing electronics 814 to determine that vehicle 10 is in a garage. To enhance the determination that vehicle 10 is in the garage, a reflector (e.g., RFID tag), or other type of object, may be disposed in the garage. The reflector may be configured to provide enhanced reflections to the sonar, radar and RF sensors, or the reflector may be configured to provide a unique reflective pattern, or reflective signal to assist processing electronics in determining whether vehicle 10 is in the garage, or which garage stall, if there are multiple garage stalls.

As described above, sonar, radar and RF sensors may be disposed in the garage (e.g., walls, ceiling, door or floor) and directed toward the garage door opening. Sonar, radar and RF sensors may be configured to assist processing electronics in determining distances to objects and may be used by processing electronics to determine the distance to the garage door when closed, and the change in distance when the garage door is open. When the garage door is open the sensors will provide data for detecting a change in distance because the sensors will detect objects outside the garage. If the detected distance does not exceed a threshold, a determination that the garage door is closed may be made. Various types of reflectors, objects or other items may be disposed in the garage to improve detection of a closed garage door.

Similarly, sonar, radar and RF sensors may be disposed in vehicle 10 and configured to determine distances from vehicle 10 to objects and may be used to determine that the garage door is closed. The sensors may be disposed on vehicle 10 such that the transmitted signal is directed toward the garage door in either the open or closed position when vehicle 10 is parked in the garage. The sensors transmit a signal, receive signal reflections from nearby objects and provide data to processing electronics 814 to determine distances to the nearby objects. If the sensors are directed toward the ceiling to detect an open position, then processing electronics 814 determines that the garage door is closed if the measured distance is greater than a threshold because the detected distance would be to the ceiling rather than the overhead garage door. If the system is directed toward the garage door opening, then processing electronics determines that the garage door is closed if the distance is less than a threshold. To enhance the determination that the garage door is closed, a reflector (e.g., RFID tag), or other type of object, may be disposed on the garage door or garage ceiling above the garage door in the open position. The reflector may be configured to provide enhanced signal reflections to the sonar, radar and RF sensors or the reflectors may be configured to provide a unique reflective pattern or reflective signal to assist processing electronics in determining that the garage door is closed, which garage vehicle 10 is in, if there are multiple garages or which garage stall, if there are multiple garage stalls.

Camera or photoelectric sensors (e.g., IR, visible red, Laser, UV) may also be disposed in either the garage or vehicle 10 to assist processing electronics in determining whether vehicle 10 is in the garage. When disposed in the garage (e.g., walls, ceiling, door or floor), the sensors may be directed toward the location in the garage where vehicle 10 is likely to park. As described above, a camera disposed in the garage may assist processing electronics 804 in recognizing vehicle 10 using image processing and pattern recognition techniques. Photoelectric sensors may be configured to assist processing electronics in determining the distance from vehicle 10 to the sensor as vehicle 10 enters and parks in the garage. As vehicle 10 approaches the sensor in the garage, the measured distance decreases. If the distance drops below a threshold, a determination that vehicle 10 is in the garage can be made. In addition to assisting in distance determination, various light sensing systems may be configured to simply assist in determining the presence of vehicle 10. For example, a UV sensor may be disposed above the location where vehicle 10 parks in the garage. Special UV paint, stickers or other type of UV reflector, which is detectable by the UV sensor may be placed in the garage floor. If vehicle 10 is parked in the garage, the UV sensor will be unable to detect the UV reflections from the reflective material on the garage floor and a determination by processing electronics that vehicle 10 is in the garage can be made. Alternatively, a UV sticker or other type of UV reflector may be disposed on top of vehicle 10. The UV sensor may be able to detect the UV reflections from reflector on vehicle 10 and a determination by processing electronics that vehicle 10 is in the garage can be made.

Other light sensing configurations disposed in the garage may configured to assist processing electronics 804 in determining whether vehicle 10 is entering or leaving the garage. For example, many garage doors include a visible red light sensor at the bottom of the opening to detect whether the opening of the garage door is obstructed by and object or person. The visible red sensor could be configured to have two parallel sensors, one closer to the garage opening and one further away from the opening, to assist in determining whether vehicle 10 is entering or exiting the garage. When vehicle 10 is entering the garage, the sensor nearest the garage opening will be blocked first by vehicle 10 and the sensor furthest from the opening will be blocked second. When vehicle 10 is leaving the garage the sensor furthest from the garage opening will be blocked first and the sensor closest to the garage opening will be blocked second. Processing electronics 804 may be able to distinguish vehicle 10 passing through the garage door opening from other objects by the time it takes for vehicle 10 to pass through the garage door opening. For example, it will typically take much longer for vehicle 10 to pass through the opening that for a person, or a child on a bicycle. Additionally, other sensors may be used to confirm that vehicle 10 is either in or out of the garage. The other sensors may be activated by the sensing of an object passing through the garage door opening. In addition to assisting in distance determination by processing electronics, various light sensors may be configured to assist processing electronics in determining the presence of vehicle 10. For example, a UV sensor may be disposed above the location where vehicle 10 parks in the garage, as described above.

A camera disposed on a vehicle, such as a bumper camera, may be configured to assist processing electronics 814 in recognizing certain aspects of the garage. The ability of processing electronics 814 to determine that vehicle 10 is in the garage or to uniquely recognize the garage or garage stall, may be enhanced by stickers, markers, objects or other items in the garage or on the garage walls or door. Photoelectric sensors may be configured to assist in determining the distance from vehicle 10 to the garage interior as vehicle 10 enters and parks in the garage. As vehicle 10 approaches the garage, the measured distance decreases. If the distance drops below a threshold, a determination that vehicle 10 is in the garage can be made.

Camera or photoelectric sensors (e.g., IR, visible red, Laser, UV) may also be disposed in either the garage or vehicle 10 to assist processing electronics in determining whether the garage door is closed. When disposed in the garage (e.g., walls, ceiling, door or floor) or in vehicle 10, the sensors may be directed toward the garage door (in either the open or closed position). Processing electronics 804 may use image processing and pattern recognition techniques to recognize certain aspects of the garage that would indicate that the garage door is closed. For example, if the image is dark but it is day time, it may be assumed that the garage is dark during the day time because the garage is closed. Other recognizable aspects of the garage may include color, shape, shading, brightness, darkness, contrasting colors, sizes of shapes, etc. The user may enhance the ability of processing electronics 804 to uniquely recognize that the garage door is closed by including stickers, markers, objects or other items. For example, a camera may be affixed to a garage wall, or the back of vehicle 10, and positioned to face the garage door. The inside of the garage door may have a sticker recognizable by processing electronics using the camera. If the door is closed, processing electronics 804 using the camera will detect the sticker and if the garage door is closed the sticker will not be detected.

Photoelectric sensors disposed in the garage or vehicle 10 may be configured in a variety of ways to assist processing electronics in determining the whether the garage door is closed. For example, a photo signal, or light signal, may be directed toward the garage door opening from either vehicle 10 or a fixed position in the garage. If the garage door is shut, the processing electronics 804 may use data received from photoelectric sensor to determine a distance to the closed garage door. If the garage door is open the determined distance will be greater than the distance to the garage door because the distance will be to objects located outside the garage. If it is determined that the distance being measured is less than a threshold, a determination that the garage door is closed may be made. A photoelectric sensor may be affixed to the ceiling above the garage door when the garage door is in an open position, the open position of the garage door obstructing the view of photoelectric sensor. In the open position, processing electronics 804 uses photoelectric sensor to determine the distance to the open garage door. When the garage door is closed, processing electronics 804 uses photoelectric sensor to determine the distance to the top of vehicle 10 or the distance to the floor. In either case, the distance will be different from the distance to the garage door while in open position. If it is determined that the distance being measured is greater than a threshold (e.g., the distance to the garage door while in open position), it may be determined that the garage door is closed. The garage door opener 14 and control system 822 may include a memory configured to store measurement data, including thresholds. Current measurement data may be compared to stored measurement data or corresponding thresholds to determine whether the garage door is open. The user may also use stickers, paint, reflectors, or other items to be used in conjunction with the various types of photoelectric sensors to assist processing electronics in determining whether the garage door is closed or in determining a unique identity of the particular garage door. For example, the user could put special UV paint or stickers on the inside of the garage door to assist in detecting the reflections of UV light to determine that the garage door is in either a closed or an open position. Other types of light frequencies and corresponding items (e.g., stickers, paint, reflectors) could be used in various configurations to assist in determining whether the garage door is closed.

A capacitive sensor may be disposed in the garage and coupled to interface 802 and configured to assist processing electronics in determining whether to actuate the garage door. A capacitive sensor may be configured to measure the capacitance between an electrode (e.g., a conductive plate) disposed in the garage and vehicle 10 entering and parking in the garage. As vehicle 10 enters the garage and approaches the electrode, the capacitance measured between vehicle 10 and the electrode increases. The electrode in the garage may be positioned on the garage wall facing vehicle 10 as it enters the garage or it may be positioned above the location where vehicle 10 parks in the garage. The electrode may be integrated into the garage floor or a mat that vehicle 10 parks on top of in the garage.

Capacitive sensor may also be disposed in either the garage or vehicle 10 to assist processing electronics in determining whether the garage door is closed. A capacitive sensor requires at least two electrodes. One of the electrodes may be disposed on the inside or out side of the garage door, or alternatively, embedded within the garage door. The other electrode may be disposed on the garage door ceiling above the garage door when the garage door is in an open position. In the open position, the electrode on the ceiling and the electrode on the garage door are relatively close to one another, which should result in a relatively strong capacitance measurement. In the closed position, the electrodes are relatively far apart, which should result in a relatively weak capacitance measurement. If the measured capacitance is relatively weak (below a threshold) then processing electronics may determine that the garage door is closed. An electrode may also be placed at the bottom of the garage door while the other electrode may be placed on the garage floor in the garage door opening where garage door contacts the floor when closed. The electrode on the floor may be integrated into the floor or may be in the form of a strip that runs along the opening of the garage door configured to help seal the garage door when in the closed position. When the garage door is closed, the electrodes are closed together and should result in a relatively high measured capacitance. When the door is open, the electrodes are far apart and should result in a relatively low measured capacitance. If the measured capacitance is high, processing electronics may determine that the door is closed. An electrode may be disposed on vehicle 10 and on the garage door. If the electrode is disposed on the back of vehicle 10 (e.g., rear bumper), the capacitance measured between the vehicle electrode and the garage door electrode will be greater when the garaged door is closed. Various other configurations are possible.

An emission pattern sensor and a pressure sensor may be disposed in the garage and coupled to interface 802 and configured to assist processing electronics 804 in determining whether to actuate the garage door. As described above, an emission pattern sensor may be used to by processing electronics 804 to determine whether vehicle 10 in the garage has started or stopped. If it determines that vehicle 10 has started and the emissions fade away, it may be determined that vehicle 10 has just left the garage. If it determines that vehicle 10 has just shut down and the emissions fade away, it may be determined that vehicle 10 is still located in the garage. Also described above, is a pressure sensor used by processing electronics 804 to determine whether vehicle 10 is located in a garage. The pressure sensor may be in the form of a mat disposed on the garage floor and configured to sense the weight of vehicle 10 when parked in the garage. The pressure sensor may also be integrated in to the garage floor to assist processing electronics 804 in determining the presence of vehicle 10. The pressure sensor may also be a strip or tube sensitive to pressure and placed on the garage floor parallel to the garage door opening. Two parallel strips, or a single strip with two integrated parallel pressure tubes may be used by processing electronics 804 to determine the direction of vehicle 10 as described above. Further, processing electronics may be configured to distinguish between the pressure caused by vehicle 10 and the pressure caused by a person or bicycle.

Vehicle 10 may be equipped with a GPS or any other type of location determination or navigation system. The GPS may include dead reckoning functionality to determine the location of vehicle 10 in areas where a satellite signal is unavailable or unreliable. The GPS system may assist in determining that vehicle 10 is in the garage. The garage location may be identified by the GPS system as a location of interest and further defined as a garage location. The GPS system may be incapable of receiving satellite signal while in the garage, however, the GPS system or vehicle processing electronics may be configured to recognize that vehicle 10 is entering the garage if vehicle 10 is in close proximity to the garage and moving toward the garage when the signal is lost. Additionally, GPS system may be configured with dead reckoning which allows the vehicle navigation system to continue to calculate the location of vehicle 10 based on the vehicle's speed and heading. The dead reckoning capabilities may be used by processing electronics to determine that vehicle 10 is parked in the garage. GPS, and other location determination systems, may be configured to indicate the garage stall in which vehicle 10 is parked.

Control system 822 and the garage door opener 14 may be configured to communicate with one another when in close proximity using RF signals or other types of communication signals to determine whether vehicle 10 is in the garage. The signal strength of the communication signals may be such that control system 822 and the garage door opener 14 may only be capable of communicating when vehicle 10 is substantially located in the garage. Alternatively, determining the distance between vehicle 10 and the garage may be accomplished by measuring the time it takes for a signal to be transmitted and then returned to the transmitting device, or comparing the signal strength of the transmitted signal to the received signal, or both the transmission time and the signal strength may be used. As vehicle 10 is moves closer to the garage, the transmission time will decrease and the received signal strength will increase. Control system 822 may be configured to transmit an RF signal and the garage door opener 14 may include an RF ID tag or some type of processing electronics to communicate or reflect the signal back to vehicle 10. Conversely, the garage door electronics may be configured to transmit the RF signal and vehicle 10 may include an RF ID tag or some type of processing electronics to communicate or reflect the signal back to vehicle 10. Rather than continuously transmit a signal, the garage door electronics, or vehicle 10, may be configured to send out a periodic signal to conserve energy or processing power, or may be triggered by other events, such as the actuation of the garage door, the GPS system determining that vehicle 10 is within a predetermined proximity to the garage.

While the different types of sensors and systems for sensing have been discussed individually, it is to be understood that the sensors and systems may be used in various combinations to determine whether vehicle 10 is started, whether vehicle 10 is in the garage and whether the garage door is closed.

Processing electronics 804 of garage door opener 14 may be configured to monitor the state of the garage door 18, such that processing electronics 804 knows whether the garage door is in a closed or open position. The state of the garage door may be controlled and monitored by various processing electronics, including a state machine. The current position of the door may be stored in memory 808 and provided to either processing electronics 804 or control system 822 for processing to determine whether the garage door needs to be actuated.

Further, rather than, or in addition to, opening the garage door, vehicle 10 may be configured to shut off when a it is determined that vehicle 10 is started, that vehicle 10 is located in the garage and that the garage door is closed. Turing off vehicle may also prevent a harmful garage environment. The garage door may also be activated if harmful conditions are detected, such as high CO or $CO_2$ levels, even if no determination has been made regarding a started engine or location of the engine in the garage. In addition to, or in place of, opening the garage door, garage windows or vents in the garage door, ceiling or walls may be actuated to provide needed ventilation. If vehicle 10 is started by remote starter, a vehicle started signal may be provided for processing to determine whether other conditions are met for actuation. Or the actuation of the starter may request an actuation of the garage door if the state of the garage door is the closed position. A closed position may be determined by using the state stored in memory or by some other sensor coupled to garage door opener 14 or vehicle 10. Further, emergency notification may be sent to a homeowner through a home alarm system, text messaging, pager, email, or phone in response to an emergency actuation, the determination of a need for actuation or the detection of a harmful condition.

Further, it is to be understood that PHEV, combustion engine electrical power generator, or any other type of combustion engine may be substituted for vehicle 10. The processing electronics used by the vehicle may be implemented as a single processor or any number of processors, including processor that may be embedding in the various sensors. The sensors used may be embedded in or affixed to the vehicle by the manufacturer or may be later installed. Further, the processing electronics may be implemented outside the vehicle as a stand alone system separate from the vehicle control system and may be configured to provide a wired or wireless emergency actuation signal to the garage door opener. External processing electronics and vehicle control system may also be configured to share the sensing and/or processing needed for determining whether to actuate the garage door.

The processing electronics used by garage door electronics may be implemented as a single processor or any number of processors, including processor that may be embedding in the various sensors. The various sensors and processors need not be embedded in the garage door opener, but may be located anywhere in the garage. Further, the garage door electronics, including all of the processing electronics and sensors, may be implemented outside the garage door opener with sensors disposed in the garage as a stand alone system separate from the garage door opener. Garage door electronics may be configured to provide a wired or wireless emergency actuation signal to the garage door opener. Garage door electronics and garage door opener may also be configured to share the sensing and processing needed for determining whether to actuate the garage door.

Figure 10:
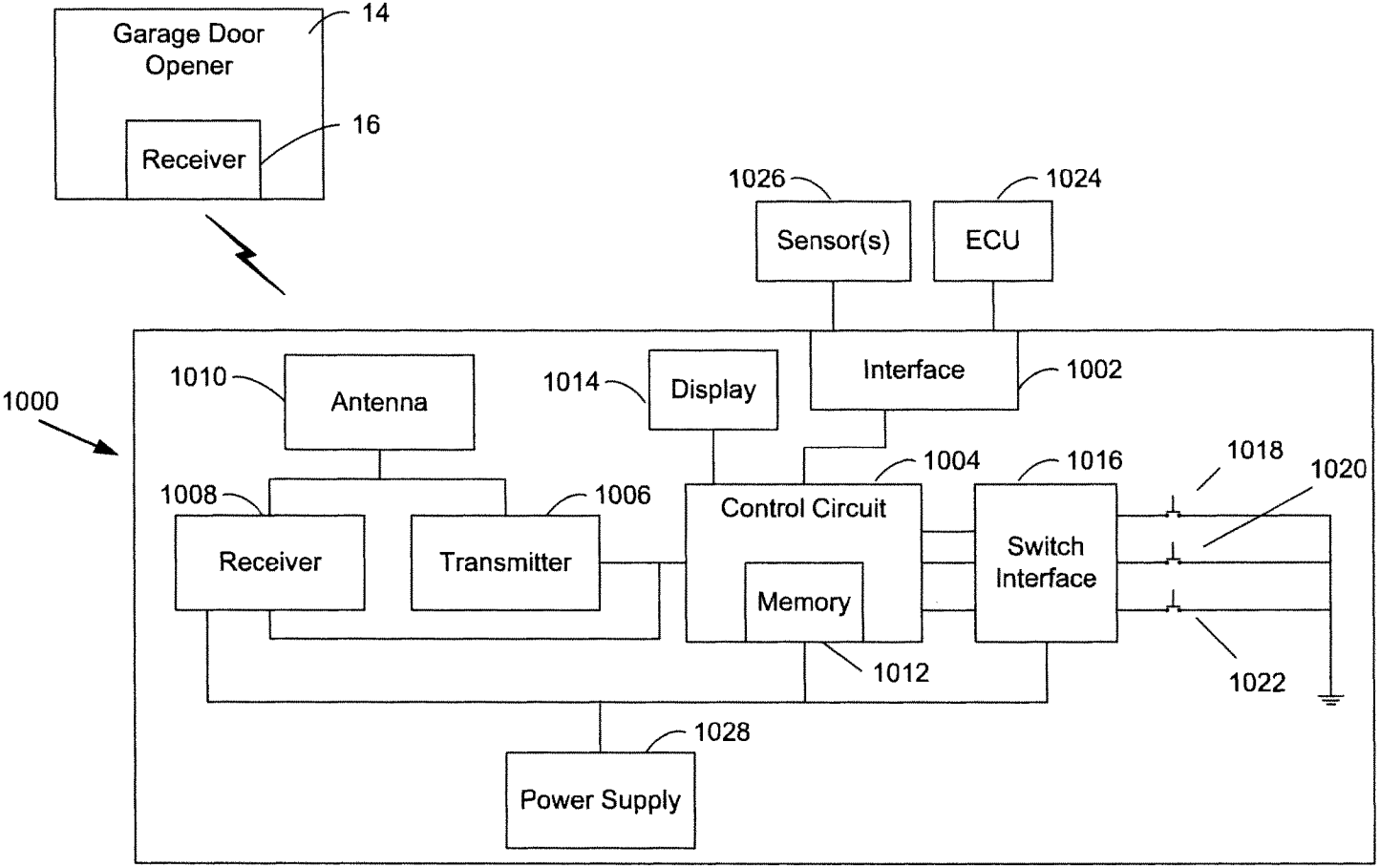
FIG. 10 is a schematic block diagram of a trainable transmitter in used to cause the garage door opener to actuate the garage door.

Referring to FIG. 10, control system 822 disposed in vehicle 10 may be a trainable transmitter. Trainable transmitter 1000 includes a transmitter circuit 1006 and a receiver 1008 that are coupled to an antenna 1010. In another embodiment, a single dual function transceiver having transmit and receive circuitry may be provided in place of a separate receiver and transmitter. Transmitter circuit 1006 and receiver 1008 are also coupled to a control circuit 1004. Control circuit 1004 may include various types of control circuitry, digital and/or analog, and may include a microprocessor, microcontroller, application specific integrated circuit (ASIC), or other digital and/or analog circuitry configured to perform various input/output, control, analysis, and other functions to be described herein. A switch interface 1016 is coupled to a plurality of buttons or switches. Alternatively, other user input devices such as knobs, dials, etc., or a voice actuated input control circuit configured to receive voice signals from a vehicle occupant may be provided to receive user input. In an exemplary embodiment, switch interface 1016 is coupled to one terminal of each of three push button switches 1018, 1020 and 1022, which have their remaining terminal connected to ground. Switches 1018, 1020 and 1022 may each be associated with a separate remote control system to be controlled, each of which may have its own unique operating RF frequency, modulation scheme, and/or control data. Thus, switches 1018, 1020 and 1022 each correspond to a different radio frequency channel for transmitter circuit 1006. It should be understood, however, that each channel may be trained to the same original transmitter, if desired, or to different original transmitters.

Trainable transmitter 1000 may also be configured to include an interface 1002 coupled to control circuit 1004. Interface 1002 is also coupled to one or more sensors 1026 and/or ECU 1024 and configured to receive data from sensors 1026 and ECU 1024 and to provide the received data to control circuit 1004. Control circuit may be configured to process the received data and determine whether to provide an actuation command to transmitter 1006 for causing the garage door 14 to actuate the garage door 18.

Switch interface 1016 couples signal information from switches 1018, 1020 and 1022 to the input terminals of control circuit 1004. Control circuit 1004 includes data input terminals for receiving signals from the switch interface 1016 indicative of the closure states of switches 1018, 1020 and 1022. A power supply 1028 is conventionally coupled to the various components for supplying the necessary operating power in a conventional manner.

Control circuit 1004 is also coupled to a display 1014 which includes a display element such as a light emitting diode (LED). Display 1014 may alternatively include other display elements, such as a liquid crystal display (LCD), a vacuum fluorescent display (VFD), or other display elements. Control circuit 1004 includes a memory 1012 including volatile and/or non-volatile memory to, for example, store a computer program or other software to perform the functions described herein. Memory 1012 is configured to store learned information such as control data and carrier frequency information that may be associated with switches 1018, 1020 and 1022. In addition, for rolling code or other cryptographically encoded remote control systems, information regarding the rolling code or cryptographic algorithms for each system may be pre-stored and associated with frequencies and control data that may be used to identify a particular type of remote control system and, therefore, the appropriate cryptographic algorithm for the remote control system. As discussed previously, each switch or button 1018, 1020 and 1022 may be associated with a separate remote control system, such as different garage door openers, electronically operated access gates, house lighting controls and other remote control systems, each which may have its own unique operating RF frequency, modulation scheme and control data.

Transmitter circuit 1006 and receiver 1008 communicate with the garage door opener 14 via antenna 1010. Garage door opener 14 may be configured to receive control signals via receiver 16. Receiver 1008 may be used to receive signals via antenna 1010 and transmitter circuit 1006 may be used to transmit signals via antenna 1010. In an alternative embodiment, a separate antenna may be used with transmitter 1006 and with receiver 1008 (e.g., separate transmit and receive antennas may be provided in the trainable transmitter). Once a channel of trainable transmitter 1000 has been trained, trainable transmitter 1000 is configured to transmit a wireless control signal having control data that will control garage door opener 14. For example, in response to actuation of a switch, such as switch 1018, transmitter circuit 1006 is configured, under control from control circuit 1004, to generate a control signal having a carrier frequency and control data associated with the particular trained channel. The control data may be modulated onto the control signal using, for example, frequency shift key (FSK) modulation, amplitude shift key (ASK) modulation or other modulation technique. The control data on the control signal may be a fixed code or a rolling code or other cryptographically encoded control code suitable for use with garage door opener 14. As mentioned previously, trainable transmitter 1000 may learn the control code and carrier frequency for remote control system using an original transmitter for garage door opener 14.

Figure 11:
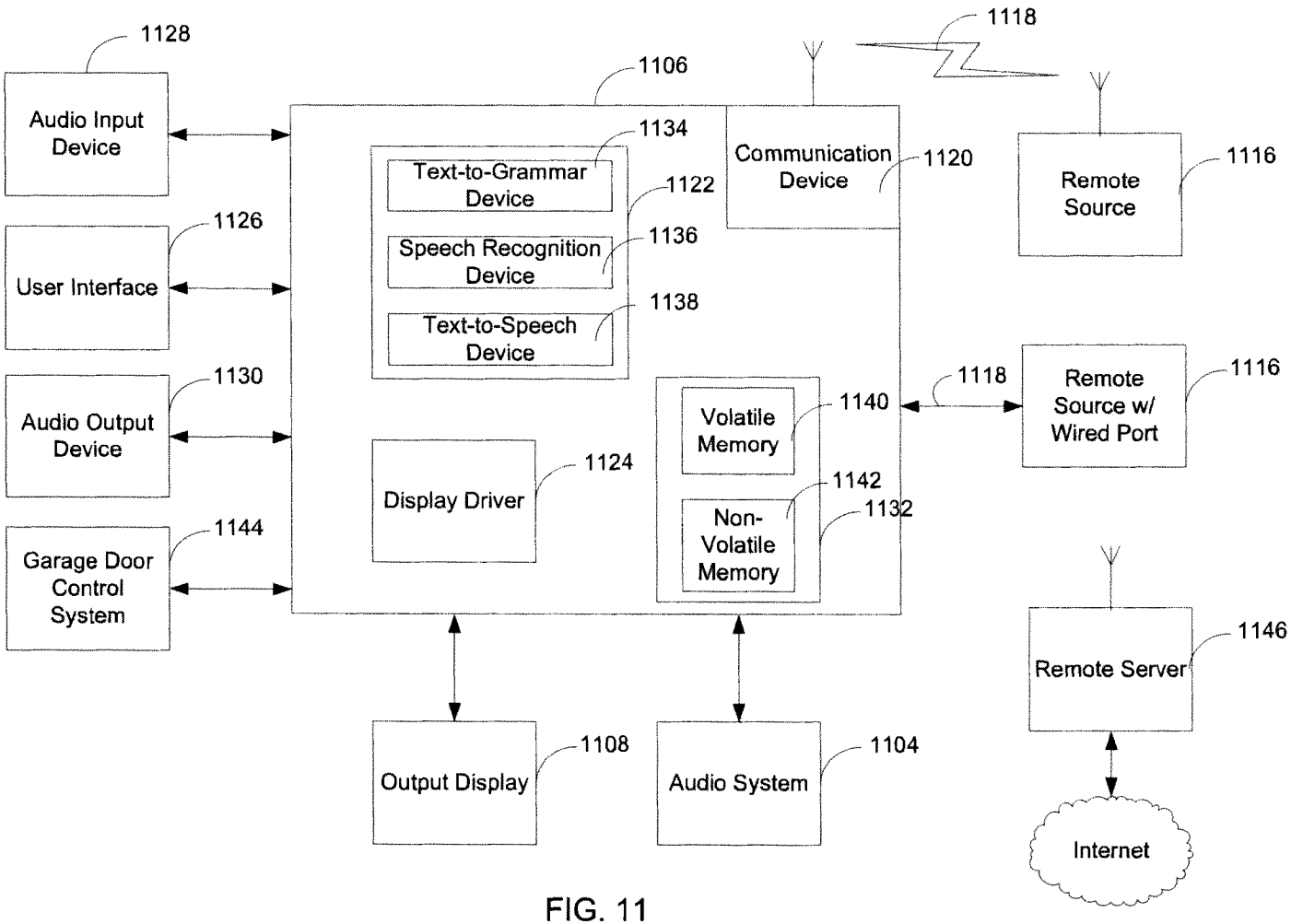
FIG. 11 is a schematic block diagram of a vehicle control system coupled to the garage door control system in the vehicle.

Referring to FIG. 11, vehicle 10 may include a control system 1106 capable of accessing data files from other remote sources 1116 over a communication link 118. For example, control system 1106 may access media data files, phonebook data files, calendar data, or any other accessible data of use by control system.

In-vehicle control system 1106 may include a communication device 1120, a data processing system 1122, a display driver 1124, an output display 1108, an user interface 1126, an audio input device 1128, an audio output device 1130, an audio system 1104, a garage door control system 1144 and a memory device 1132.

Communication device 1120 may be configured to establish communication link 1118 with remote source 1116. In one exemplary embodiment, control system 1106 may establish a wireless communication link such as with Bluetooth® communications protocol, an IEEE 802.11 protocol, an IEEE 802.16 protocol, a cellular signal, a Shared Wireless Access Protocol-Cord Access (SWAP-CA) protocol, or any other suitable wireless technology. In another exemplary embodiment, control system 1106 may establish a physical communication link such as with USB technology, Firewire technology, optical technology, other serial or parallel port technology, or any other suitable physical communication link. Communication device 1120 may receive one or more data files from remote source 1116. In various exemplary embodiments, the data files may include text, numeric data, or any combination thereof.

Data processing system 1122 is coupled to communications device 1120 and may be configured to control each function of control system 1016. Data processing system 1122 may facilitates speech recognition capabilities of control system 1106 for the convenience of the user. Data processing system 1122 may include digital or analog processing components or be of any past, present, or future design that facilitates control of control system 1106. Data processing system 1122 may be a single data processing device having various hardware and/or software components or multiple data processing devices. Data processing system 1122 may be used to facilitate any number of audio related features, including front-to-rear or rear-to-front communications features.

Display driver 1124 is coupled to an output display 1108 and may be configured to provide an electronic signal to the output display. In one exemplary embodiment, the electronic signal may include the text and/or numeric data of the data files, while in other exemplary embodiments, any other desired data may be included with the text and/or numeric data or by itself in the electronic signal to the output display. In another exemplary embodiment, display driver 1124 may be configured to control output display 1108 with touch-screen capabilities, while in other exemplary embodiments, display driver 1124 may be configured to control output display 1108 without making use of touch-screen capabilities. In still other exemplary embodiments, display driver 1124 may be of any past, present, or future design that allows for the control of output display 1108.

User interface 1126 may be configured to facilitate tactile user interaction with control system 1106. In various exemplary embodiments, user interface 1126 may include push-buttons or rotatable knobs in any configuration or may include other tactile user contact points.

Audio system 1104, for example an audio input receiver, may be configured to switch between various audio inputs, mix audio input signals into an audio output signal, provide volume control, filtering, attenuation, and/or other audio-related features. Audio system 1104 and its accompanying audio data or audio signals may be analog-based, digital-based, or any combination thereof. Audio system 1104 may include various input devices such as compact disk players, radio components, satellite radio components, digital media players, etc. According to other various embodiments, audio system 1104 may include switching, processing, or routing electronics. According to yet other various embodiments, audio system 1104 may include any number of amplifiers, or provide audio output signals to amplifiers. Audio system 1104 may include audio output devices or may provide signals to audio output devices. Audio system 1104 may be partially or entirely built into the control system 1106 or be a stand-alone audio system that accepts control and audio inputs from control system 1106 or the other components of vehicle 10. Audio system 1104 may connect to the control system 1106 via an interface module (shown as the lines connecting control system 1106 and audio system 1104 in FIG. 11) of control system 1106. Audio system 1104 may be coupled to control system 1106 via any physical or wireless communication connection as described above. According to an exemplary embodiment, audio system 1106 is any audio system of the past, present or future that accepts audio inputs and has an audio output capability.

Audio input device 1128, for example a microphone, is configured to receive the utterance of a user for transmission to data processing system 1122 for speech recognition so that the functions of control system 1106 may be operated by voice command. According to an exemplary embodiment, audio input device 1128 may be configured and used to receive user utterances for amplification to other users. Audio received by audio input device 1128 may be sent to and from other systems and components of the vehicle such as control system 1106, audio system 1104, processor 1122, memory device 1132, audio input device 1128, audio output device 1130, etc. The audio may be sent and received throughout the systems and components of vehicle 10 as audio data (e.g., audio signal(s), audio data, analog audio signal(s), digital audio signal(s), audio input signal(s), audio output signal(s), audio information, etc.). Regardless of whether the audio data or audio signal changes form, is processed, routed, amplified, attenuated, filtered or mixed, the terms "audio data" and "audio signal" may be used throughout this application to refer to any data or signal having an audio component. Audio output devices (e.g., audio output device 1130, etc.) may be configured to provide the user with an audio prompt of various functions, such as user selection confirmation. According to an exemplary embodiment, audio output devices may exist within or externally from the housing of control system 1106.

Data processing system 1122 may include a text-to-grammar device 1134, a speech recognition device 1136, and a text-to-speech device 1138. Text-to-grammar device 1134 may be coupled to communications device 1120 and may be configured to generate a phonemic representation of the text and/or numeric data of each of the data files received by communications device 1120 from remote source 116. The phonemic representation of the text and/or numeric data of each data file may be configured to facilitate speech recognition of each data file. After conversion of a data file to a phonemic representation, the data file may be accessed via an oral input command received by speech recognition device 1136 via audio input device 1128.

Speech recognition device 1136 may be configured to receive an oral input command from a user via audio input device 1128. Speech recognition device compares the received oral input command to a set of predetermined input commands, which may have been configured by text-to-grammar device 1134. In various exemplary embodiments, the input commands may be related to the playback of a media file, the dialing or input of a phone book entry, the entry or listing of calendar or contact data, the control of the HVAC system, or any other desired function to be performed on data. According to various exemplary embodiments, the input command may be related to initiating, terminating and/or otherwise controlling front-to-rear communications functions. Speech recognition device 1136 may determine an appropriate response to the oral input command received from the user, for example, whether the oral input command is a valid or invalid instruction, what command to execute, or any other appropriate response.

Text-to-speech device 1138 may be configured to convert the text and/or numeric data of each data file received from remote source 1116 into an audible speech representation. This functionality may allow control system 1106 to audibly give data to the user via audio output device 1130 or the audio system. For example, control system 1106 may repeat a user selected function back to the user, announce media file information, provide phonebook or contact information, or other information related to data stored in memory 1132 or remote source 116.

Memory device 1132 is configured to store data accessed by control system 1106. For example, memory device 1132 may store data input by remote source 1116, data created by data processing system 1122 that may be used later, intermediate data of use in a current calculation, or any other data of use by control system 1106. Memory device 1132 includes both a volatile memory 1140 and a non-volatile memory 1142. Volatile memory 1140 may be configured so that the contents stored therein may be erased during each power cycle. Non-volatile memory 1142 may be configured so that the contents stored therein may be retained across power cycles, such that upon system power-up, data from previous system use remains available for the user.

Garage door control system 1144 may be coupled to control system 1106 to utilize the speech recognition capabilities of control system 1106. The user would be able to actuate the garage door opener 14 using voice commands or configure garage door control system 1144 using voice inputs. Furthermore, garage door system 1144 may coupled to control system 1106 and configured to communicate with remote server 1146 via communication device 1120, wherein the remote server 1146 provides access to the internet.

Note that remote source 1116 may be any suitable remote source that includes a transceiver and is able to interface with control system 1106 over communications link 118 in either a wireless or physical embodiment. In various exemplary embodiments, remote source 116 may be one or more of a mobile phone, a personal digital assistant (PDA), a media player, a personal navigation device (PND), or various other remote data sources.

The exemplary embodiments illustrated in the Figures are offered by way of example only. Accordingly, the present disclosure is not limited to a particular embodiment, but extends to various modifications that nevertheless fall within the scope of the appended claims. The order or sequence of any processes or method steps may be varied or re-sequenced according to alternative embodiments.

Describing the disclosure with Figures should not be construed as imposing on the disclosure any limitations that may be present in the Figures. The present disclosure contemplates methods, systems and program products on any machine-readable media for accomplishing its operations. The embodiments of the present disclosure may be implemented using an existing computer processor(s), or by a special purpose computer processor for an appropriate vehicle system, incorporated for this or another purpose or by a hardwired system.

As noted above, embodiments within the scope of the present disclosure include program products comprising machine-readable media for carrying or having machine-executable instructions or data structures stored thereon. Such machine-readable media can be any available media which can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

It should be noted that although the diagrams herein may show a specific order of method steps, it is understood that the order of these steps may differ from what is depicted. Also, two or more steps may be performed concurrently or with partial concurrence. Such variation will depend on the software and hardware systems chosen and on designer choice. It is understood that all such variations are within the scope of the disclosure. Likewise, software implementations of the present disclosure could be accomplished with standard programming techniques with rule-based logic and other logic to accomplish the various connection steps, processing steps, comparison steps and decision steps.

The foregoing description of embodiments of the disclosure has been presented for purposes of illustration and description. It is not intended to be exhaustive or to limit the disclosure to the precise form disclosed, and modifications and variations are possible in light of the above teachings or may be acquired from practice of the disclosure. The embodiments were chosen and described in order to explain the principals of the disclosure and its practical application to enable one skilled in the art to utilize the disclosure in various embodiments and with various modifications as are suited to the particular use contemplated.

What is claimed is:

1. A method for causing a garage door opener to open a garage door, comprising:

receiving first data at a processing circuit;

determining, by the processing circuit, whether an engine of a vehicle is started based on the first data;

determining, by the processing circuit, whether the vehicle is in a garage and the garage door is closed based on the data;

wherein the data used to determine whether the vehicle is in the garage and the garage door is closed includes data related to an environmental condition within the garage and provided by at least one of an emission sensor, a vibration sensor, and a temperature sensor; and generating, by the processing circuit, a command configured to open the garage door based on determining that the engine of the vehicle is started, the vehicle is in the garage, and the garage door is closed.

2. The method of claim 1, further comprising transmitting the command to the garage door opener via a transmitter.

3. The method of claim 1, wherein the data is received from an engine control unit.

4. The method of claim 1, wherein the data is received from an environment sensor.

5. The method of claim 1, wherein the data includes state data stored in a memory indicating one of an open state or a closed state of the garage door.

6. The method of claim 5, further comprising setting the state data in the memory to the open state in response to generating the command to open the garage door.

7. The method of claim 1, further comprising continuously receiving the data until determining that the engine is started.

8. The method of claim 1, wherein determining that the vehicle is started includes comparing the data to a threshold value.

9. The method of claim 1, wherein the data is received from a field sensor configured to sense a change in a magnetic field when the engine is started.

10. A system for opening a garage door, comprising:

an interface configured to receive data from a source; and a processing circuit configured to:

determine whether an engine of a vehicle is started based on the data;

determine whether the vehicle is in a garage and the garage door is closed based on the data;

wherein the data used to determine whether the vehicle is in the garage and the garage door is closed includes data related to an environmental condition within the garage and provided by at least one of an emission sensor, a vibration sensor, and a temperature sensor; and generate a command configured to open the garage door based on determining that the engine of the vehicle is started, the vehicle is in the garage, and the garage door is closed.

11. The system of claim 10, further comprising a transmitter configured to transmit the command to the garage door opener.

12. The system of claim 10, wherein the data is received from an engine control unit.

13. The system of claim 10, wherein the data is received form an environment sensor.

14. The system of claim 10, further comprising a memory coupled to the processing circuit, the memory configured to store state data indicating one of an open state or a closed state of the garage door.

15. The system of claim 14, wherein the processing circuit is further configured to set the state data to the open state in response to generating the command to open the garage door.

16. The system of claim 10, wherein the processing circuit is configured to continuously receive the data until determining that the engine is started.

17. The system of claim 10, wherein the processing circuit is configured to determine that the vehicle is started based on comparing the data to a threshold value.

18. The system of claim 10, wherein the data is received from a field sensor configured to sense a change in a magnetic field when the engine is started.

19. The system of claim 10, wherein the system is disposed in the vehicle.

20. The system of claim 10, wherein the system is disposed in the garage.

* * * * *